US007189211B2

(12) United States Patent
Inada et al.

(10) Patent No.: US 7,189,211 B2
(45) Date of Patent: Mar. 13, 2007

(54) MASSAGE MACHINE, INFORMATION RECORDED MEDIUM, PROGRAM WRITING METHOD

(75) Inventors: Nichimu Inada, Osaka (JP); Hideshi Kondo, Osaka (JP); Koji Goto, Osaka (JP); Ryoichi Tokioka, Yamatokoriyama (JP)

(73) Assignee: Family Co., Ltd., Osaka (JP)

( * ) Notice: Subject to any disclaimer, the term of this patent is extended or adjusted under 35 U.S.C. 154(b) by 0 days.

(21) Appl. No.: 10/433,854

(22) PCT Filed: Dec. 5, 2001

(86) PCT No.: PCT/JP01/10603

§ 371 (c)(1),
(2), (4) Date: Dec. 29, 2003

(87) PCT Pub. No.: WO02/45645

PCT Pub. Date: Jun. 13, 2002

(65) Prior Publication Data

US 2004/0097851 A1 May 20, 2004

(30) Foreign Application Priority Data

Dec. 8, 2000 (JP) ..... 2000-374270
Apr. 4, 2001 (JP) ..... 2001-105894

(51) Int. Cl.
*A61H 23/00* (2006.01)

(52) U.S. Cl. ..... 601/47; 601/49; 601/52; 601/99; 601/103; 601/DIG. 12; 601/DIG. 22

(58) Field of Classification Search ..... 601/47–49, 601/52, 63, 65, 86, 87, 98, 99, 103
See application file for complete search history.

(56) References Cited

U.S. PATENT DOCUMENTS 4,015,180 A * 3/1977 Tetsugu et al. ..... 388/820

(Continued)

FOREIGN PATENT DOCUMENTS

CN 2123785 U 12/1992

(Continued)

OTHER PUBLICATIONS

International Search Report, PCT/JP01/10603, issued Mar. 5, 2002.

*Primary Examiner*—Quang D. Thanh
(74) *Attorney, Agent, or Firm*—Alleman Hall McCoy Russell & Tuttle LLP

(57) ABSTRACT

An object of the present invention is to provide a massaging apparatus that faithfully incorporates the rhythm or melody of a music source and performs massage with accents arranged more effectively based on these. A massaging apparatus of the present invention comprises massaging mechanisms (4, 5) that give mechanical impulses to a body by driving motors (5*a*, 10, 11), and a control device (13) that controls operations of the motors. The control device (13) comprises a waveform converter (18) having a waveform converting circuit for converting a waveform of an audio signal input from a sound source (A), such as a smoothing circuit, a differentiating circuit, or an integrating circuit, and a specific frequency band signal selecting unit (17) having a low pass filter, a high pass filter, and a band pass filter. In accordance with a control signal output from the waveform converter (18) and the specific frequency band signal selecting unit (17), the operations of the motors are controlled.

39 Claims, 24 Drawing Sheets

U.S. PATENT DOCUMENTS

| | | | | |
|---|---|---|---|---|
| 5,857,986 | A * | 1/1999 | Moriyasu | 601/49 |
| 6,027,463 | A * | 2/2000 | Moriyasu | 601/46 |
| 6,120,468 | A * | 9/2000 | Tseng | 601/46 |
| 6,494,851 | B1 * | 12/2002 | Becher | 601/133 |

FOREIGN PATENT DOCUMENTS

| | | |
|---|---|---|
| CN | 2369677 Y | 3/2000 |
| JP | 63-168165 | 7/1988 |
| JP | 06-225941 | 8/1994 |
| JP | 7-222781 | 8/1995 |
| JP | 7-231940 | 9/1995 |
| JP | 9-320250 | 12/1997 |
| JP | 2000-070373 | 3/2000 |

* cited by examiner (a)

(b)

| CH | MUSICAL INSTRUMENT | MASSAGING OPERATION |
|---|---|---|
| 1 | DRUM | TAPPING |
| 2 | SYNTHESIZER | KNEADING |
| 3 | PIANO | VIBRATION |
| 4 | BASE | NO MASSAGING OPERATION |
| ⋮ | | |
| 16 | NO MUSICAL INSTRUMENT | NO MASSAGING OPERATION |

(c)

| MIDI SIGNAL | CONTROL SIGNAL |
|---|---|
| VOLUME | VOLTAGE |
| TIME | TIME |
| TONE | NO COMPONENT |

(d)

| MIDI SIGNAL | CONTROL SIGNAL |
|---|---|
| VOLUME | NO COMPONENT |
| TIME | TIME |
| TONE | VOLTAGE |

(c)

MUSIC PIECE DATA : QUANTIZED AND CODED MUSIC CONTROL PROGRAM SIGNAL 304 AT HEAD OF MUSIC PIECE

P : CODE OF BOUNDARY BETWEEN MUSIC PIECE AND ANOTHER MUSIC PIECE

Q : CODE REPRESENTING MUSIC PIECE NUMBER ELAPSE TIME ,ETC FOR EVERY 98 FRAMES

R~W : USER' S BIT

S0 , S1 : SUB-CODING FRAME SYNCHRONIZATION CODE (a)

(b)

MUSIC PIECE DATA : QUANTIZED AND CODED MUSIC

P : CODE OF BOUNDARY BETWEEN MUSIC PIECE AND ANOTHER MUSIC PIECE

Q : CODE REPRESENTING MUSIC PIECE NUMBER , ELAPSE TIME ,ETC FOR EVERY 98 FRAMES (c) R~U : QUANTIZED AND CODED KNEADING OPERATION

W : QUANTIZED AND CODED TAPPING OPERATION

W : QUANTIZED AND CODED VIBRATION OPERATION

S0 , S1 : SUB-CODING FRAME SYNCHRONIZATION CODE (a)

| TRACK | TYPE OF SIGNAL |
|---|---|
| LCH | LEFT CH SOUND |
| RCH | RIGHT CH SOUND |
| R | KNEADING PROGRAM |
| G | TAPPING PROGRAM |
| B | VIBRATION PROGRAM |

(b)

MASSAGE MACHINE, INFORMATION RECORDED MEDIUM, PROGRAM WRITING METHOD

TECHNICAL FIELD

The present invention relates to a massaging apparatus, and more particularly to a massaging apparatus that uses an audio signal as a control signal for a massaging operation.

BACKGROUND ART

Conventionally, there has been known a massaging apparatus that receives an external input such as the sound of a musical instrument or sound effect and converts the input into mechanical vibration of a vibrating element, thereby producing a massage effect. This type of massaging apparatus includes a chair equipped with a vibration device disclosed in Japanese Utility Model Application Publication No. Hei. 2-96133. This publication does not clearly show a configuration of a vibrating element or mechanism of vibration, but a frequency band of not higher than about 100 Hz of a music source such as an external musical instrument or sound effect is caused to pass through a low pass filter and is electrically amplified, thereby turning on and off vibration of the vibrating element by a rhythm of the music source. This massaging apparatus is intended to avoid a negative effect such as vibration or the like associated with an input signal mainly composed of a voice by utilizing the source with a low frequency band.

However, when a music source with only a frequency band of not higher than about 100 Hz is used as the vibration source, audio within medium and high frequency bands is not used, so that the massaging operation might repeat simple rhythms. For example, with music that repeats a bass line (low-frequency band), various sounds within medium and high frequency bands such as sound from a piano, a cymbal, etc., are not used, and the resulting massaging becomes continuous and simple. As should be appreciated, the massage effect is produced by the vibrating element, but a user to be massaged does not expect relaxation effects produced by the music source.

Further, the following important problems arise. The audio signal is composed of a set of waves of substantially U-shape or inverted U-shape which has a width almost equal to half of a cycle. Therefore, if the audio signal in the low frequency band is directly amplified up to a usable voltage range of a motor and given to the motor, the resulting output becomes much smaller than that in the case where the motor is continuously driven (without the use of the audio signal).

When the massaging operation is a vibration operation and the music signal that has passed through the low pass filter is used as the control signal as in the above conventional example, the tempo of music or rise and fall of the music might be reflected in the massaging operation naturally to some degree because the control signal is extracted from the music signal. However, the tempo of music or rise and fall of the music are not always reflected in the massaging operations such as kneading or tapping, because frequencies of such massaging operations are lower than that of the vibration operation. When the tempo of music or rise and fall of the music are not reflected in the massaging operation, this is not comfortable to the user.

When an attempt is made to reflect the tempo of music in the massaging operation, it should be considered that there is a response delay with respect to the control signal due to inertia or the like in the drive system of the massaging mechanism including a motor.

Meanwhile, when sequence control is performed without the use of music, an expertise for programming is required to create a massaging program. Besides, since a content of program is difficult to know by intuition, it takes time to create the program, errors tend to occur, and the like.

SUMMARY OF THE INVENTION

The present invention has been developed to solve the above-described problems, and an object of the present invention is to provide a massaging apparatus capable of performing massaging that faithfully incorporates rhythm or melody of a music source, and massaging that effectively arranges accents of the rhythm or melody of the music source.

Another object of the present invention is to provide a massaging apparatus capable of performing various types of massaging operations according to music.

Another object of the present invention is to provide a massaging apparatus capable of reflecting tempo of music or rise and fall of the music on the massaging operations.

Another object of the present invention is to provide a massaging apparatus capable of adapting tempo of the music to the massaging operation, regardless of response delay with respect to a control signal.

A further object of the present invention is to provide a massaging apparatus capable of easily creating a control program for massage.

In order to achieve these objects, according to the present invention, there is provided a massaging apparatus comprising a massaging mechanism that gives a mechanical impulse to a body of a user to be massaged; a motor for driving the massaging mechanism; and a control device for controlling an operation of the motor, wherein the control device is configured to generate a control signal for controlling the operation of the motor based on an audio signal input from a sound source.

In accordance with the massaging apparatus, control signals for causing the motor to perform operations suitable for massage are generated based on audios in medium and high frequency bands as well as audio in low frequency band. Thereby, the motor can be operated according to the audios in all frequency bands. As a result, massage that faithfully incorporates rhythm or melody of the music source, and that arranges accents more effectively based on the rhythm or melody of the music source, is carried out. That is, the user feels massaged comfortably.

Preferably, in the massaging apparatus, the massaging mechanism has a massaging element connected to the output shaft of the motor so as to be displaced according to the operation of the motor. This is because, depending on the direction in which the massaging element is displaced, the kneading effect, the tapping effect, and rolling effect (back straightening effect) are obtained according to the audio source. As defined herein, "the massaging mechanism is connected to the motor" includes a condition in which the massaging element is connected to the motor through a belt, a cam, a link mechanism, a chain, a screw delivery mechanism, etc., to allow a power to be transmitted to the motor.

The control device may include a waveform converter having a waveform converting circuit for converting a waveform of an audio signal input from the sound source, and may be configured to control the operation of the motor using the control signal output from the waveform converter.

In accordance with the massaging apparatus, the audio signal is not directly used to control the operation of the motor, but the waveform of the audio signal is processed by using, for example, a smoothing circuit as the waveform converter and the resulting control signal is delivered to the motor. By doing so, even the audio signal in a medium or high frequency band which does not output a sufficient power if used directly as the control signal, can give sufficient electric energy to the motor. Therefore, the operation of the motor is suitably controlled by the music source, including sound in a medium or high frequency band and the musical rhythm or melody can be taken in as a pattern of the massage. As a result, various massages are performed according to music and the comfort of the massage is improved. Meanwhile, discomfort caused by a difference between the music and the rhythm of the conventional massage is reduced. That is, the difference between the tempo of music and the tempo of variation in a pressing force of the massage is significantly reduced. A differentiating circuit or an integrating circuit, for use as the waveform converter, processes a waveform of the audio signal in various ways and delivers it to the motor as the control signal. For example, the waveform of the audio signal is converted into a pulse signal by the differentiating circuit, thereby obtaining a strong-weak massage. Also, the audio signal is converted into a smooth waveform by the integrating circuit, thereby achieving a slow massage.

Preferably, in the massaging apparatus in which the control device includes a bias circuit that adds or removes a signal having a constant value or a signal having a regularly varying value to or from an amplitude of a signal output from the waveform converter, the motor continues to be operated during a period corresponding to the biased signal by adding a signal. This is because, without the absence of the audio signal from the sound source, constant massage can continue.

In the massaging apparatus in which the control device includes a specific frequency band signal selecting unit having a filter that selects and passes a frequency band of the audio signal, variation in the process of the audio signal is increased. Preferably, the specific frequency band signal selecting unit includes at least one of a low pass filter, a high pass filter, and a band pass filter. The specific frequency band signal selecting unit may be located upstream or downstream of the waveform converter, but preferably, the unit is provided upstream because the control signal is selected more freely. As used herein, "upstream" is based on a flow direction of the audio signal toward the motor.

Preferably, in the massaging apparatus having a gain-adjusting circuit for increasing or decreasing an amplitude of the control signal, a percentage of constant continuous operation of the motor based on the bias signal and percentage of the various operations of the motor according to the audio signal are changed. This is preferable, because the constant, continuous massages or various massages according to rhythm or melody to be mainly used is selected. The gain-adjusting circuit may be located upstream or downstream of the bias circuit.

In the massaging apparatus further comprising an operation mode setting unit that changes and sets the operation mode of the massaging mechanism by switching of the control signal to the motor, the operation mode setting unit being configured to switch the control signal by changing and setting the waveform converting circuit, or further comprising a specific frequency band signal selecting unit, the operation mode setting unit being configured to switch the control signal by changing and setting the waveform converting circuit and/or by selecting and setting the filter, the operation mode of the massaging mechanism is changed by conversion of the control signal.

In accordance with these massaging apparatuses, a frequency band of the audio signal is selected and processed waveform is arbitrarily extracted, or these are combined, thereby deriving patterns of operation control of plural kinds of motors from one type of audio signal. That is, massage patterns are obtained based on content of the music sources.

Preferably, the massaging apparatus having the operation mode setting unit, may further comprise an operation mode storage unit for storing plural kinds of operation modes, and the operation mode setting unit may be configured to select the operation mode from the operation modes stored in the operation mode storage unit and switch the control signal according to the selected operation mode. This is because a desired operation mode of the user, corresponding to an audio source, is always reproduced.

Preferably, in the massaging apparatus, the operation mode setting unit has an operation portion with which an operator enters the operation mode, because an operator can set a desired operation mode of the audio source.

Preferably, in the massaging apparatus, the massaging mechanism comprising a vibration motor with eccentric weight added to an output shaft thereof, in order to obtain massage effects by vibration corresponding to the audio source.

In the massaging apparatus further comprising an input terminal for receiving the audio signal from the sound source through an electric cable, the audio signal can be taken in faithfully without noise input as compared to the conventional apparatus in which a sound wave signal from a microphone is received and, based on this, the motor is controlled. This avoids undesired operation.

In the massaging apparatus, the control device may be configured to convert a composite audio signal composed of plural signals associated with one another into the control signal, the composite audio signal being input from a sound source including the audio signal, and to execute control using the converted control signal.

With this configuration, when the composite audio signal is composed of plural audio signals associated with one another, various massages are performed according to the music. And, when the composite audio signal is composed of the audio signal and the control program signal created to correspond to the audio signal, the tempo of music or rise and fall of the music are reflected in the massaging operation.

The composite audio signal may be composed of the audio signal and a control program signal created to cause the massaging mechanism to operate according to the audio signal, and the control device may be configured to convert the control program signal into the control signal when the audio signal and the control program signal are input. With this configuration, since the control program signal corresponds to the audio signal, comfortable massage is performed in synchronization with music and according to tempo of music or rise and fall of the music.

The composite audio signal may be a MIDI signal, and the control device may be configured to demodulate the MIDI signal. With this configuration, using the MIDI system, the control program is audiovisually and easily created, and the composite audio signal is easily transmitted.

The MIDI signal may be composed of plural music signals representing parts of a music, and the control device may be configured to convert at least one of the plural music signals into the control signal. With this configuration, massage can be performed according to the music.

The control program signal converted into the control signal may be advanced by predetermined time with respect to the audio signal output to the signal path reaching the sound output device from which audio is listened to by the user. With this configuration, response delay with respect to the control signal in the drive system of the massaging mechanism is corrected and massage according to the tempo of the music is carried out.

A data storage medium of the present invention is a data storage medium that contains a control program created to control a massaging operation, the control program being read from the data storage medium by a data playback device and input to a control portion of a massaging apparatus, and the control program is created to allow the massaging operation to be carried out according to an audio signal representing an audio product, and is stored together with the audio signal representing the audio product. With this configuration, the data stored in the data storage medium is read out by the data playback device and is input to the control portion of the massaging apparatus. Thereby, massage according to music is performed.

The control program may be created so as to be advanced by predetermined time with respect to the audio signal on a time axis. With this configuration, response delay with respect to the control signal in the drive system of the massaging mechanism is corrected and massage according to tempo of music is carried out.

According to the present invention, there is provided a method of creating a program for controlling massaging operation in a massaging apparatus by operating a computer having a display means and an input means, comprising the steps of arranging and displaying a plurality of musical sheets on the display means; displaying a musical score representing predetermined music on one of the plurality of musical sheets; and writing a musical note corresponding to the massaging operation on another musical sheet of the plurality of musical sheets by using the input means.

With this configuration, the control program according to an audio product can be created audiovisually and easily.

The above and further objects and features of the invention will more fully be apparent from the following detailed description with accompanying drawings.

DETAILED DESCRIPTION AND BEST MODE FOR CARRYING OUT THE INVENTION

Hereinafter, embodiments of the present invention will be described with reference to the accompanying drawings.

Embodiment 1

Figure 1:
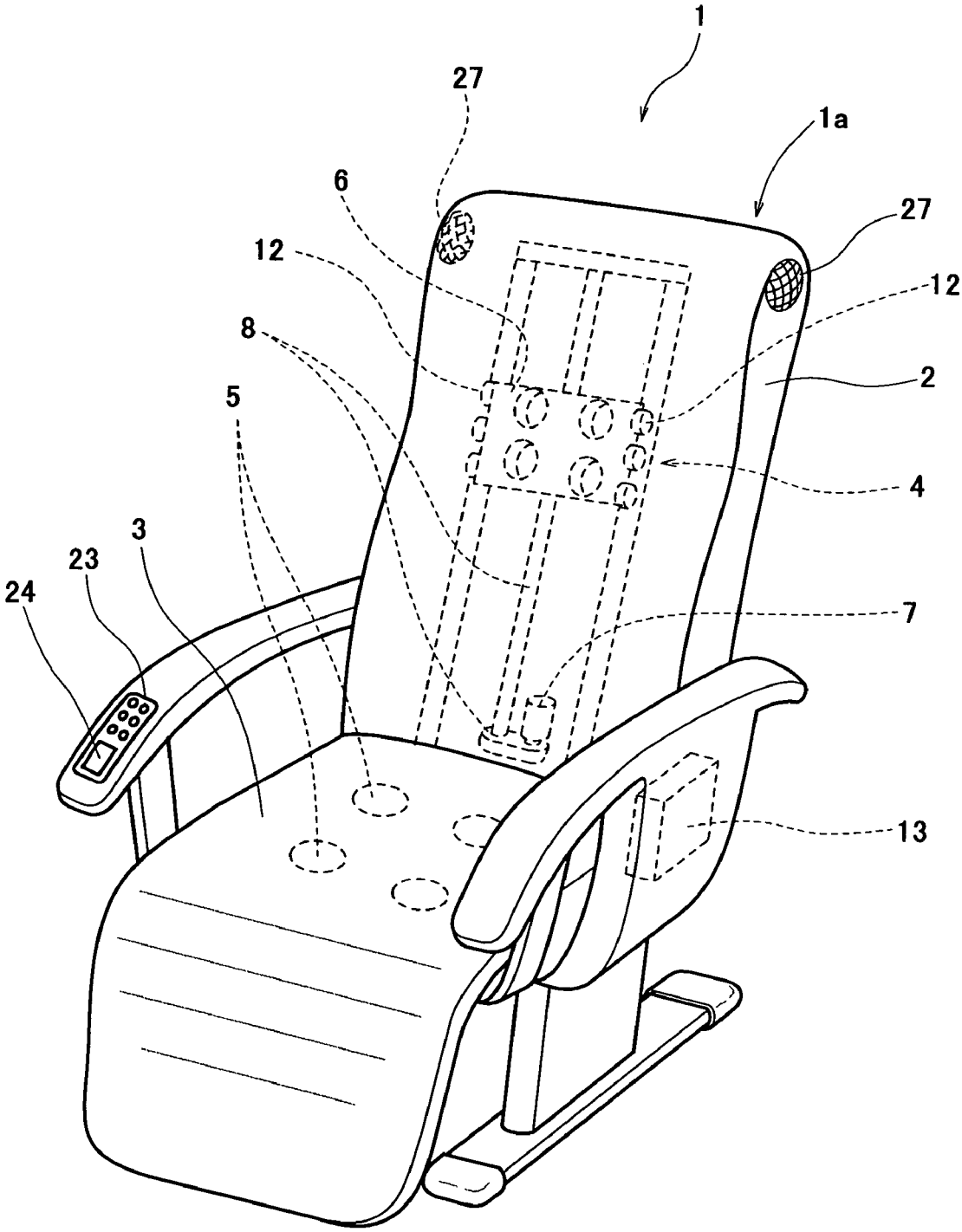
FIG. 1 is a perspective view showing an embodiment of a massaging apparatus of the present invention.
Figure 2:
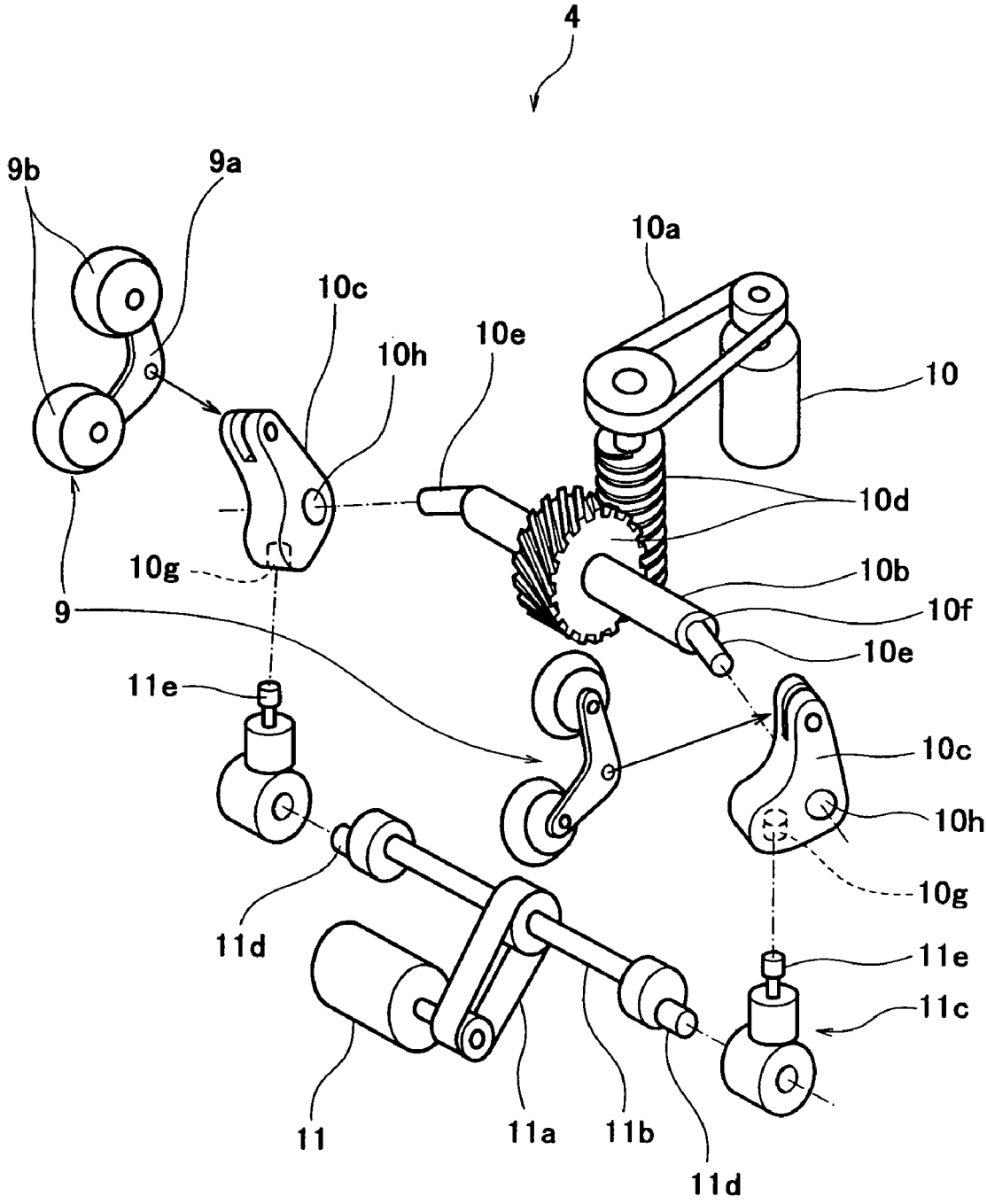
FIG. 2 is a perspective view showing an example of a massaging mechanism in the massaging apparatus in FIG. 1.

FIG. 1 is a perspective view showing a configuration of hardware of a massaging apparatus according to a first embodiment of the present invention. FIG. 2 is a perspective view showing an example of a massaging mechanism in the massaging apparatus in FIG. 1.

A massaging apparatus 1 has a chair-shaped body 1*a*. A back portion 2 and a seat portion 3 are provided with massaging mechanisms 4 and 5, respectively. The massaging mechanism 4 of the back portion 2 is attached on an up-down base 6 capable of up-down movement along a back face. The up-down base 6 is caused to move up and down by a motor 7 and a screw delivery mechanism 8. By up-and-down movement of the up-down mechanism 6, the massaging mechanism 4 moves up and down while massaging the waist, back, shoulder, neck, and head of a user seated on the body 1*a*.

With reference to FIGS. 1 and 2, the massaging mechanism 4 has a pair of massaging elements 9 that give mechanical impulses to a body of the user and motors 10 and 11 that drive the massaging elements 9 to be displaced. The kneading motor 10 serves to displace two kneading heads 9*b* attached on tip ends of a V-shaped arm 9*a* of each massaging element 9 substantially in the circumferential direction of an oval. Specifically, the kneading motor 10 drives a worm gear mechanism 10*d* through a belt 10. The worm gear mechanism 10*d* causes a kneading shaft 10*b* to rotate around its axis. The kneading shaft 10*b* is provided at both ends with small-diameter inclined shaft portions 10*e* that are respectively rotatably fitted to fitting holes 10*h* of V-shaped con rods 10*c*. The arms 9*a* are attached on tip ends of the con rods 10*c* so as to be rotatable within a restricted rotational angle range. Therefore, when the kneading shaft 10*b* rotates, the con rods 10*c* are inclined and rotate while being restricted by stepped faces 10*f* of the inclined shaft portions 10*e*. As a result, the pair of arms 9*a* are inclined and rotate to be close to or spaced apart from each other. This operation corresponds to a kneading operation of the massaging elements 9.

Meanwhile, the tapping motor 11 serves to displace the kneading heads 9*b* toward the user. Specifically, the tapping motor 11 causes a tapping shaft 11*b* to rotate around its axis through a belt 11*a*. The tapping shaft 11*b* is provided at both ends with small-diameter eccentric shaft portions 11*d* to which connecting rods 11*c* are respectively rotatably fitted. Connecting protrusions 11*e* are formed on upper sides of the connecting rods 11*c* to be slidably fitted to fitting holes 10*g* of the con rods 10*c*. The fitting holes 10*g* are spaced apart from another fitting holes 10*h* of the con rods 10*c*. With the above structure, when the tapping shaft 11*b* rotates, the connecting rods 11*c* move up and down and the con rods 10*c* reciprocate and rotate around the fitting holes 10*h*, so that the massaging elements 9 reciprocate with respect to the user. This is called a tapping operation.

Thus, the kneading operation and tapping operation are carried out by independent drive systems. Also, these operations are combined and carried out. As a matter of course, each operation can be carried out independently. In FIG. 1, reference numeral 12 denotes guide rollers for guiding up and down movement of the up-down base 6.

Figure 3:
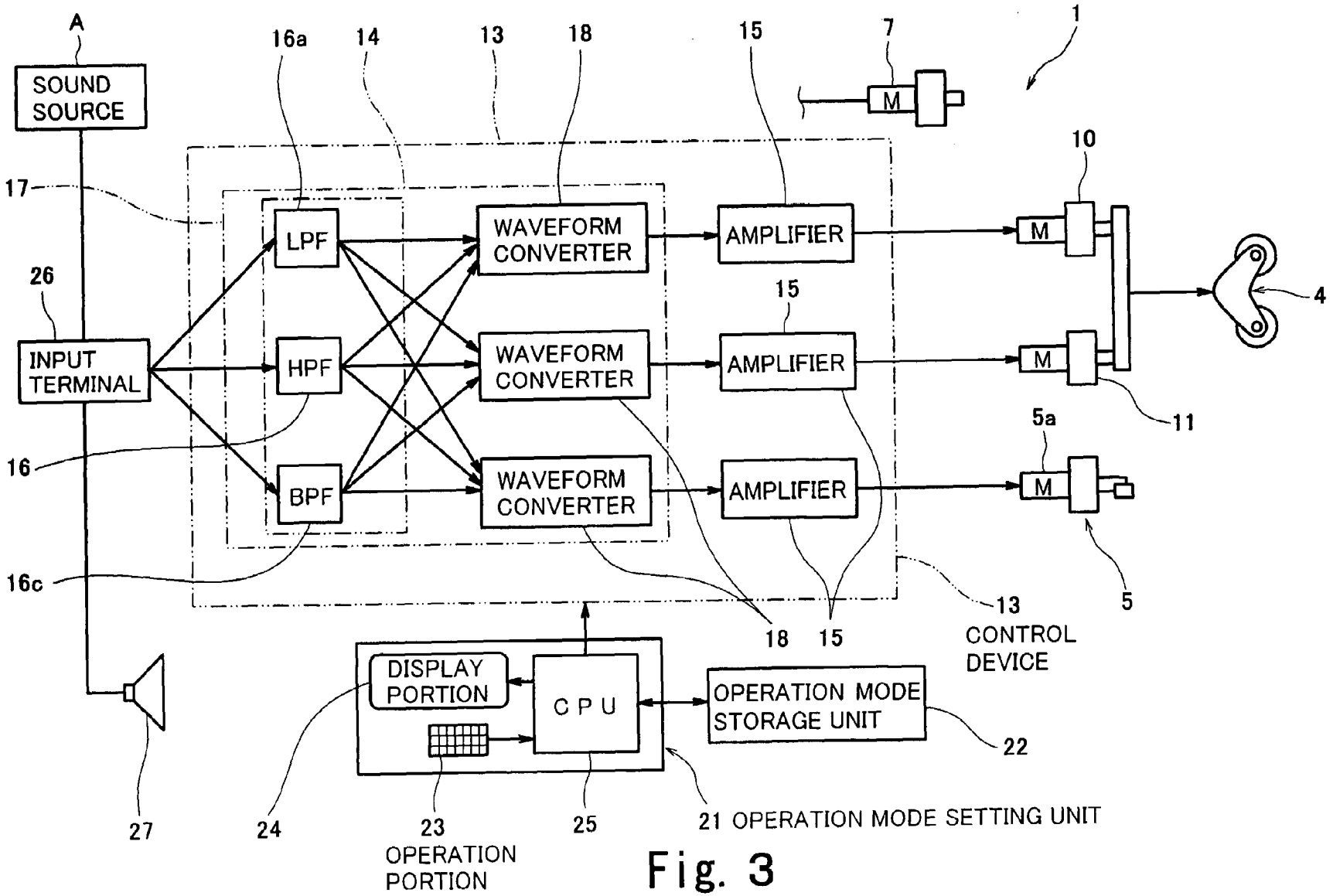
FIG. 3 is a block diagram showing an example of a control device of a motor in the massaging apparatus in FIG. 1.

The massaging mechanism 5 in the seat portion 3 serves to give vibration to the body of the user and is comprised of a vibration motor 5*a* (see FIG. 3). The vibration motor 5*a* has an output shaft with eccentric weight attached thereon and the motor itself vibrates by rotation of the weight.

The massaging apparatus 1 has a built-in control device 13 for controlling rotation of the motors 5*a*, 10, and 11 for massaging operations in accordance with an audio signal. The control device 13 is configured to control rotation of the respective motors based on various audio sources, thereby achieving various types of massaging operations. The massaging apparatus 1 is provided with an operation mode setting unit 21 (see FIG. 3) for setting a control process of the control device 13 and speakers 27 for allowing the user to listen to audio from the audio source at upper end portions of right and left side portions of the back portion 2.

FIG. 3 is a block diagram showing a schematic configuration of the control system of the massaging apparatus 1. As shown in FIG. 3, the control device 13 controls operations of three types of motors 5*a*, 10, and 11; that is, the kneading operation, the tapping operation, and the vibration. An up-down motor 7 for reciprocating the up-down base 6 is vertically reciprocatable at a constant pitch without depending on the audio signal. As a matter of course, the up-down motor 7 of the up-down base 6 may be controlled in accordance with the audio signal by the control device 13.

The control device 13 comprises a preamplifier 14 that processes the audio signal and amplifiers (main amplifier) 15 that amplify the processed audio signal. The preamplifier 14 comprises a specific frequency band signal selecting unit 17 having a plurality of filters 16*a*, 16*b*, and 16*c* that select and pass frequency bands of the audio signal, and waveform converters 18 that convert selected waveforms of the audio signal. In this embodiment, a D.C. motor is used and, therefore, a power control means such as a known EFT (field effect transistor) may be used. The preamplifier 14 and the amplifiers 15 are provided for the three types of motors 5*a*, 10, and 11. In other words, the control portion is provided for each of the motors 5*a*, 10, and 11 to independently control each of them. As a matter of course, the specific frequency band signal selecting unit 17 may be shared among the waveform converters. This simplifies a control circuit.

Figure 4:
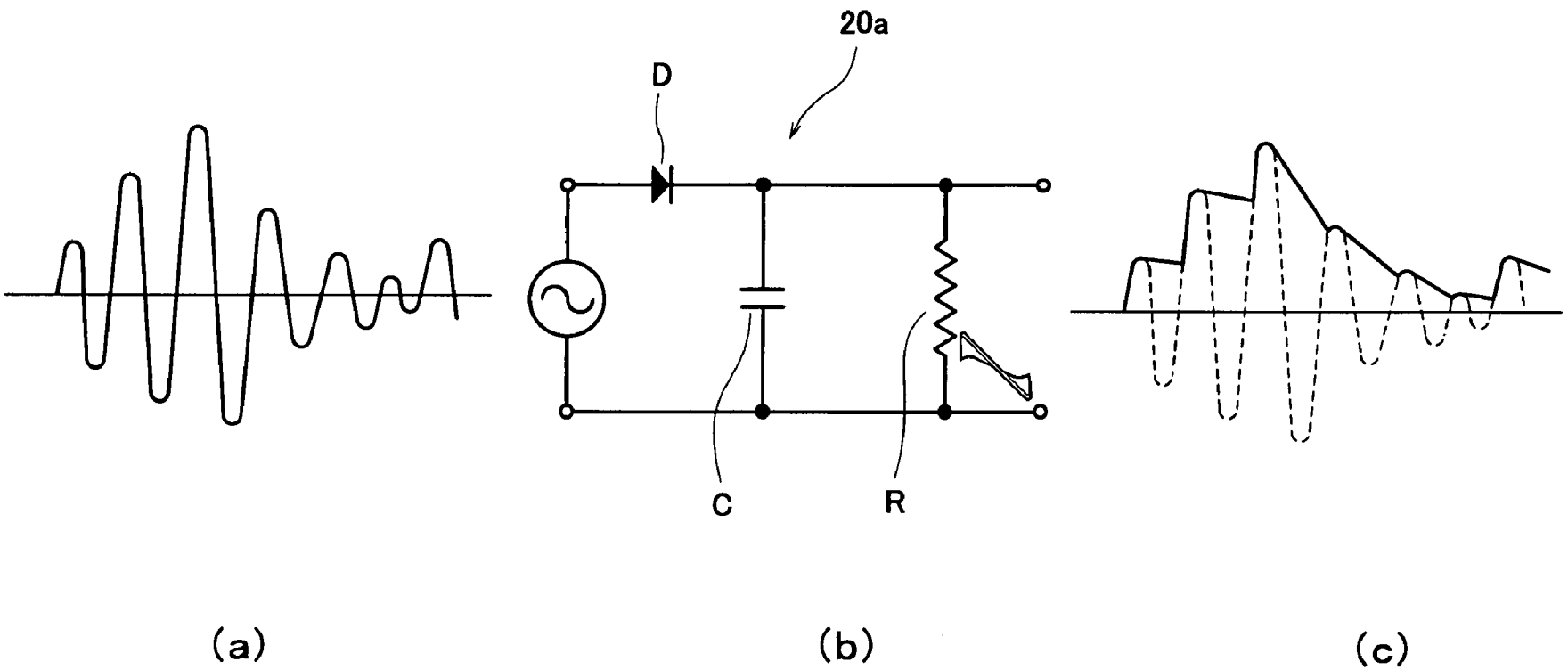
FIG. 4 is a circuit diagram showing an example of a rectifier and smoothing circuit in the control device in FIG. 3, wherein FIG. 4(*a*) shows a waveform of an audio signal, FIG. 4(*b*) shows the circuit, and FIG. 4(*c*) shows a signal output from the smoothing circuit.
Figure 5:
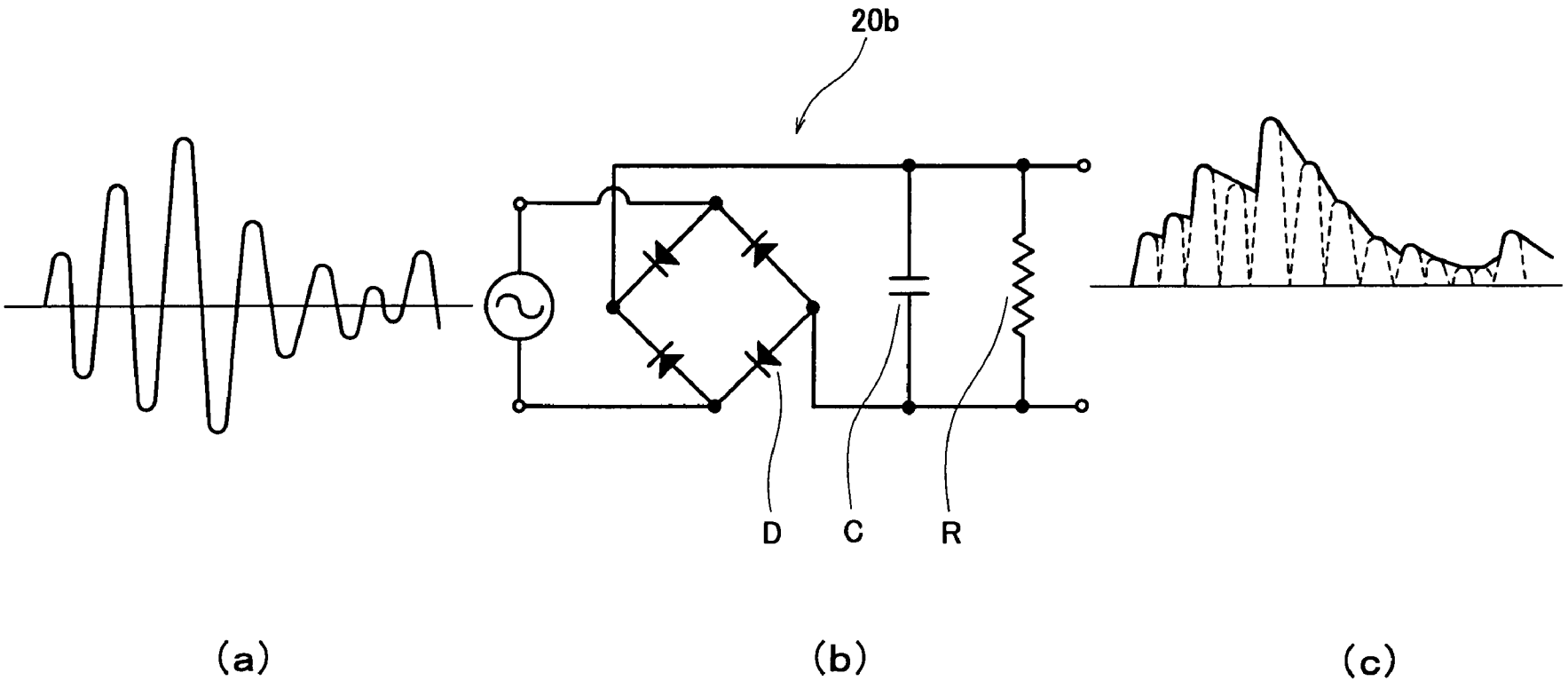
FIG. 5 is a circuit diagram showing another example of the rectifier and smoothing circuit in the control device in FIG. 3, wherein FIG. 5(*a*) shows a waveform of an audio signal, FIG. 5(*b*) shows the circuit, and FIG. 5(*c*) shows a signal output from the smoothing circuit.

In this embodiment, the filters are a high-pass filter 16*a* that passes only a frequency band higher than a predetermined frequency, a low-pass filter 16*b* that passes only a frequency band lower than the predetermined frequency, and a band-pass filter 16*c* that passes only a signal with a specific frequency band. The waveform converter 18 has a differentiating circuit, an integrating circuit, and a smoothing circuit. The smoothing circuit has a half-wave rectifier and smoothing circuit 20*a* as shown in FIG. 4, or a full-wave rectifier and smoothing circuit 20*b* as shown in FIG. 5, each of which has a rectifying function. FIG. 4(*a*) and FIG. 5(*a*) show waveforms of the audio signals, FIGS. 4(*b*) and 5(*b*) show the circuits, and FIGS. 4(*c*) and 5(*c*) show signal output from the smoothing circuit. In these Figures, D denotes a diode, C denotes a capacitor, and R denotes resistance.

The massaging apparatus 1 further comprises the operation mode setting unit 21 that instructs the preamplifier 14 to process the audio signal, and an operation mode storage unit 22 connected to the operation mode setting unit 21. The processing of the audio signal means selection of the filters 16*a*, 16*b*, and 16*c* by the specific frequency band signal selecting unit 17, selection and combination of circuits in the waveform converter 18, and combination of the selected filters and circuits. Specifically, the smoothing circuit 20*a* or 20*b* smoothes the audio signal extracted by the selected filter to form a power sufficient to drive the motor. Or, the differentiating circuit causes the audio signal to have a waveform component that rapidly changes, or the integrating circuit causes the audio signal to have a component that varies. In this manner, the operation mode is changed so that the motors enhance the massage effect. The operation mode setting unit 21 is configured to set an operation mode (processing pattern of the audio signal) by an operator (user) with the operation portion 23. A menu of the operation modes is displayed on the display portion 24 and the operation mode selected by the operation portion 23 is displayed on the display portion 24. A CPU 25 of the operation mode setting unit 21 is configured to run a program according to selection by the operation portion 23 and process the audio signal to have a pattern corresponding to the selected operation mode. Upon a new operation mode being entered and set with the operation portion 23, this information is stored in the operation mode storage unit 22.

Control signals (audio signals) of the motors 5*a*, 10, and 11 are derived from an external sound source A of the massaging apparatus 1. The sound source A is an audio source, including an audio playback device such as a record player, a CD player, an MD player, a MIDI sound source, or a tape deck, a television tuner, a radio, etc. The audio is generated from the sound source A by playback from an audio data storage medium such as a record, a CD, and the like, live play, live broadcast, and the like. The audio signal from the sound source A is input to an input terminal 26 of the massaging apparatus 1 through an electric cable. Instead of the external sound source, a signal generator that generates signals corresponding to various rhythms may be incorporated into the massaging apparatus 1. These incorporated signals may be repeated rhythms of a waltz, tango, march, and so forth. Since the signal is input in a line from the audio signal source, noises are shut out and a desired audio signal is accurately taken in.

In accordance with the massaging apparatus 1, different signal process patterns can be set in the control devices 13 of the respective motors based on one audio signal. For example, operation patterns vary depending on massage positions in such a manner that, in an audio signal derived from jazz as the music source, a signal with a low frequency band such as drum and base is allocated to the control signal of the tapping motor 11, a signal with a medium frequency band such as vocal, piano, and guitar is allocated to the control signal of the kneading motor 10, and a signal with a high frequency band such as a cymbal is allocated to the control signal of the vibration motor 5*a*.

The massaging apparatus 1 is also configured to directly output the audio signal input from the sound source A from the speakers 27 as a sound output portion through an amplifier (not shown). As a matter of course, there may be provided an output terminal for directly outputting the audio signal taken in. In that case, the output terminal may be connected to an external audio equipment. In any case, the user can listen to the audio signal taken in as music. In other words, since the user can listen to music based on the sound source by the sound synchronized with the massage, massage effects are enhanced and preferable relaxation effects are obtained. It should be appreciated that, since the massage performed by the massaging elements or the like is mechanical movement of the these members into which the audio signal has been eventually converted, some delay with respect to oscillation of sound occurs. In that case, a buffer memory is provided on a sound output side for improved synchronization with the massage.

Figure 6:
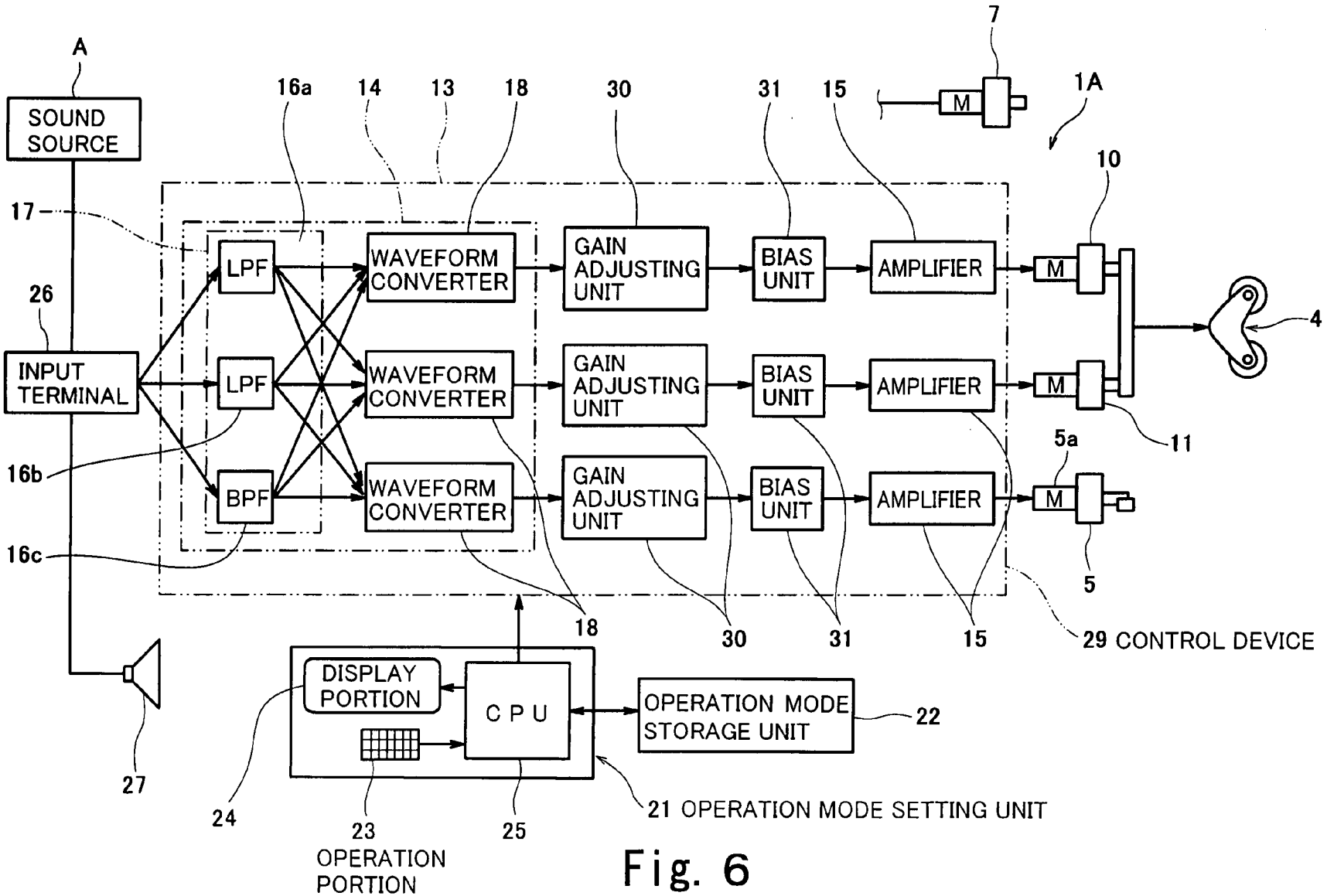
FIG. 6 is a block diagram showing an example of a control device in another embodiment of the massaging apparatus of the present invention.

FIG. 6 is a block diagram showing another configuration of the control system of the massaging apparatus according to this embodiment. A massaging apparatus 1A comprises an input terminal 26, and a control device 29 having a specific frequency band signal selecting unit 17 having filters 16*a*, 16*b*, and 16*c*, waveform converters 18 and amplifiers 15. The control device 29 has gain-adjusting units 30 and bias units 31 in this order from the upstream side between the waveform converters 18 and the amplifiers 15. The gain-adjusting units 30 are each comprised of a circuit that increases or decreases an amplitude of the audio signal output from the corresponding waveform converter 18. The bias units 31 are each comprised of a circuit that adds or removes a signal having a constant value or a regularly varying value to or from the amplitude of the audio signal output from the corresponding gain-adjusting unit 30. So, by adding or removing the signal having the constant value by the bias unit 31, the gain moves in parallel with the pulse unchanged. On the other hand, by adding or removing the signal having the regularly varying value, an undulation component is added to a variation of musical rhythm.

In the control device 13 in FIG. 3, the motors stop and massaging is not carried out without the audio signal, whereas in the control device 29 in FIG. 6, the motors are always driven and the massage effects are obtained when the bias units 31 add the signals having the constant value without the audio signal. When the bias units 31 and the gain adjusting units 30 are used together, 30% of the motor speed is set by bias and the remaining 70% is assumed to be a maximum width of variation in the audio signal by gain adjustment, thus adjusting variation in percentage within 70%. This percentage is illustrative. By such an operation, bias component and gain-adjustment component are well balanced and, thereby, continuous massage or massage with musical variation is selected to be mainly used.

By combining the bias effect and the gain-adjustment effect using these units 30 and 31, a power supply ratio among the kneading motor 10, the tapping motor 11, and the vibration motor 5*a* is varied. For example, the following operation modes are preset and an operation mode is selected according to the user's preference, depending on the kind of the music source selected by the user. Examples of the operation mode are soft mode (kneading: 100%, tapping: 0%, vibration: 50%), normal mode (kneading: 100%, tapping: 50%, vibration: 50%), and hard mode (kneading: 100%, tapping: 100%, vibration: 100%), etc.

Embodiment 2

Figure 7:
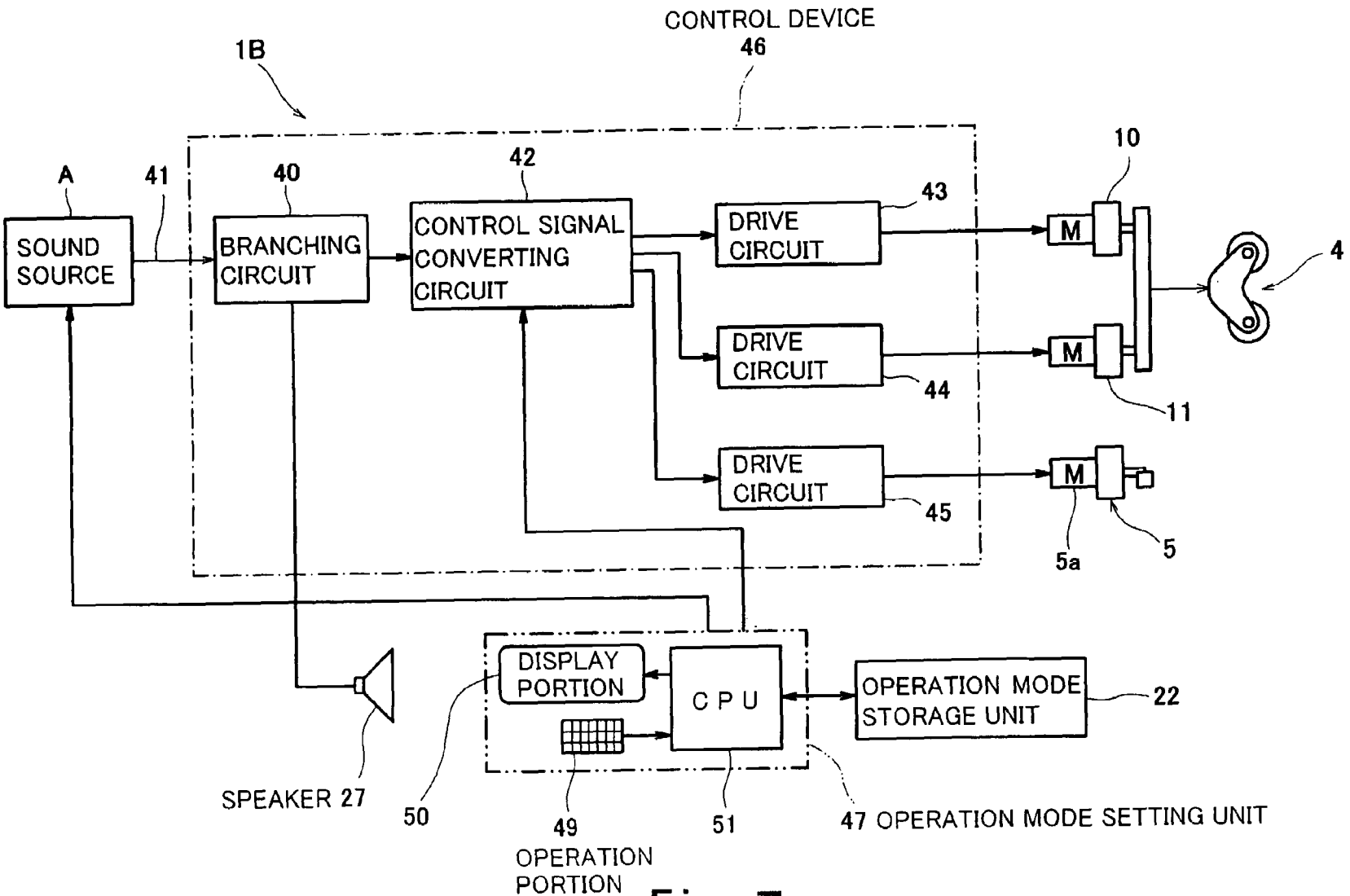
FIG. 7 is a block diagram showing a schematic configuration of a control system of a massaging apparatus according to a second embodiment of the present invention.

FIG. 7 is a block diagram showing a configuration of a control system of a massaging apparatus according to a second embodiment of the present invention. As shown in FIG. 7, in a massaging apparatus 1B of this embodiment, a composite audio signal 41 from a sound source A is input to a branching circuit 40.

As used herein, the composite audio signal 41 refers to a signal comprising plural signals including an audio signal, specifically, a signal comprising combination of plural audio signals, or combination of the audio signal and a control program signal. The control program signal refers to a signal containing a program to operate the massaging mechanism 4 or 5 as desired. The audio signal refers to a signal that produces some audio effect when played back, and does not include the control program signal. This is because the control program signal would produce some audio effect when played back as sound, but the present invention is intended to allow the user to feel the audio effect by the massaging operation and, therefore, the audio signal needs to produce some audio effects which can be felt by the user, while the control program causes the audio signal to function so that such audio effect is felt by the user, and thus, these signals should be distinguished and distinguishable.

The massaging apparatus 1B comprises the branching circuit 40 that divides the input composite audio signal 41 into an audio signal for a speaker 27 and signals for control and outputs these signals, the speaker 27 that converts the audio signal output from the branching circuit 40 into audio and outputs the audio, a control signal converting circuit 42 that allocates the signals for control output from the branching circuit 40 to the three motors 10, 11, and 5*a* and converts these signals into control signals, drive circuits 43, 44, and 45 for driving the motors 10, 11, and 5*a* in accordance with the control signals output from the control signal converting circuit 42, and the kneading motor 10, the tapping motor 11, and the vibration motor 5*a* which are driven by the drive circuits 43, 44, and 45, respectively. Therefore, the up-down motor for reciprocating the up-down base vertically reciprocates at a constant pitch without depending on the composite audio signal. As a matter of course, the up-down motor may be controlled by the control device 46 in accordance with the control signal. The branching circuit 40, the control signal converting circuit 42, and the drive circuits 43, 44, and 45 configure the control device 46.

The massaging apparatus 1B further comprises an operation mode setting unit 47 that sets a process of converting the composite audio signal to the control signals by the control signal converting circuit 42 as an operation mode and instructs the sound source to be ON or OFF or select the music, and a storage unit 48 that stores the operation mode set by the operation mode setting unit 47. The operation mode setting unit 47 comprises an operation portion 49 with which a setting instruction of the operation mode is entered, a display portion 50 on which setting information of the operation mode is displayed, and a CPU 51 that processes the input from the operation portion 49 and sets the operation mode, displays the setting information on the display portion 50, stores and read out the setting information in and from the storage unit 48, and gives an instruction to the control signal converting circuit 42 and the sound source A based on the set information.

Figure 8:
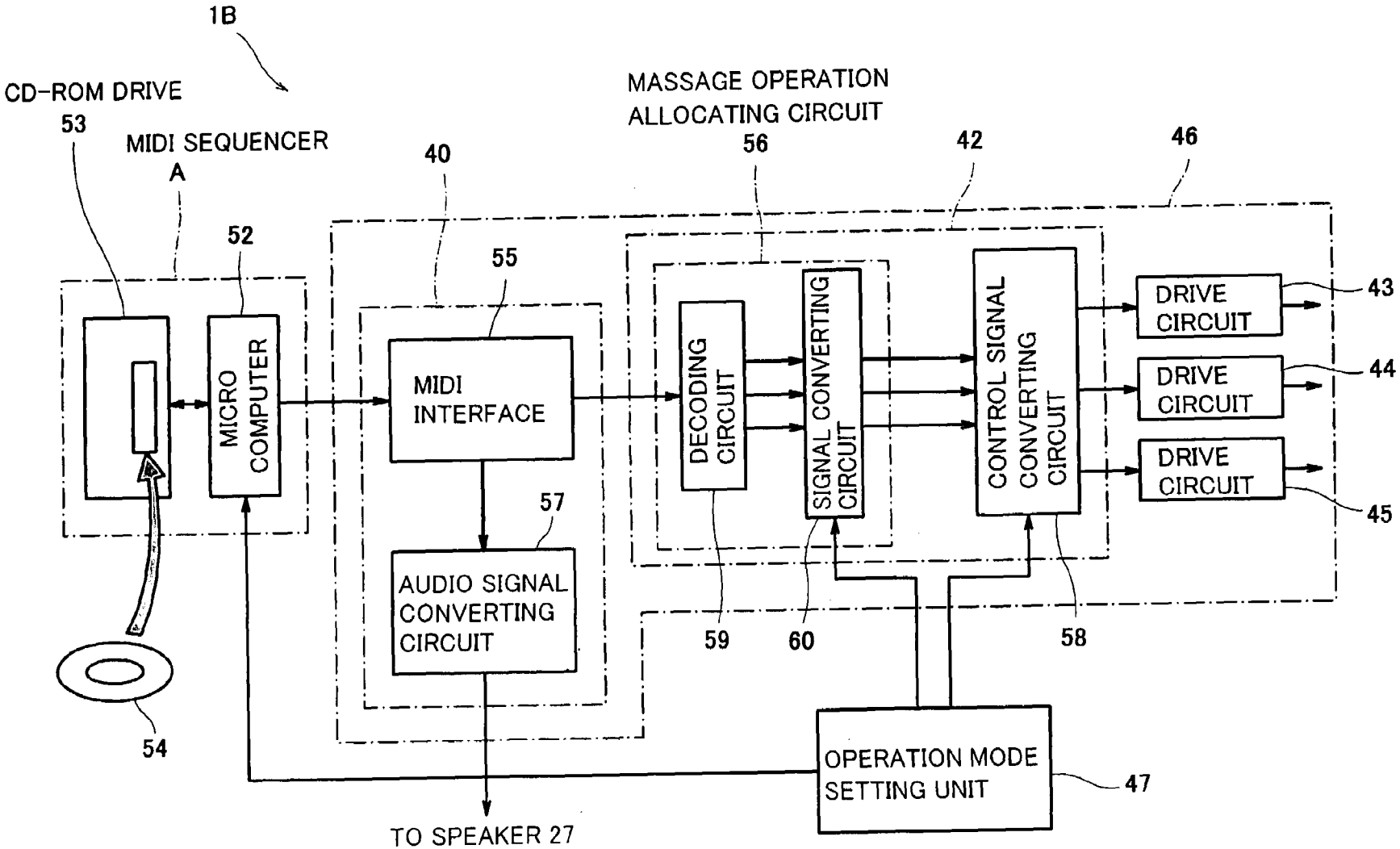
FIG. 8 is a block diagram showing a detailed configuration of blocks in FIG. 7.

FIG. 8 is a block diagram showing a detailed configuration of blocks. As shown in FIG. 8, in this embodiment, a MIDI (Musical Instrument Digital Interface) sequencer is used as a sound source. In more detail, the sound source A is the MIDI sequencer. The MIDI sequencer A is built in the massaging apparatus 1B, and comprises a microcomputer 52 in which MIDI sequence soft is installed, and a CD-ROM drive 53 connected to the microcomputer 52. The CD-ROM drive 53 is loaded with a CD-ROM 54 containing MIDI message. A massaging operation allocating circuit 56 and an audio signal converting circuit 57 are connected to the MIDI sequencer A through a MIDI interface 55. A control signal converting circuit 58 is connected to the massaging operation allocating circuit 56 and the drive circuits 43, 44, and 45 are connected to the control signal converting circuit 58. The massaging operation allocating circuit 56 and the control signal converting circuit 58 constitute a control signal circuit 42. The speaker 27 is connected to the audio signal converting circuit 57. The MIDI interface 55 and the audio signal converting circuit 57 constitute the branching circuit 40.

Figure 9:
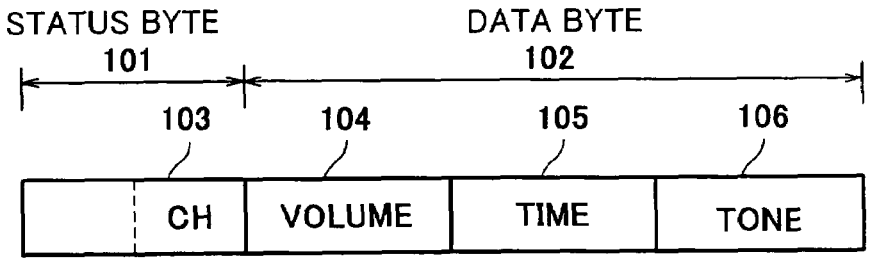
FIG. 9 is a view showing a structure of a MIDI message and a converting method thereof, wherein FIG. 9(*a*) is a schematic view showing the structure of the MIDI message, FIG. 9(*b*) is a table showing a correspondence between channels in the MIDI message, and musical instruments and massaging operations, FIG. 9(*c*) is a view showing an example of a correspondence between a MIDI signal and a control signal, and FIG. 9(*d*) is a view showing another example showing a correspondence between the MIDI signal and the control signal.

FIG. 9 is a view showing a structure of the MIDI message and a converting method thereof, wherein FIG. 9(*a*) is a schematic view showing a structure of the MIDI message, FIG. 9(*b*) is a table showing a correspondence between channels in the MIDI message, and musical instruments and massaging operations, and FIG. 9(*c*) is a view showing an example of a correspondence between the MIDI signal and the control signal.

With reference to FIGS. 8 and 9, in a MIDI system, control information of the system is transmitted and received in the form of a message. As defined herein, the control information is called the MDI message. Therefore, the output MDI message means a MDI signal. FIG. 9(*a*) shows an example of the MDI message, which is digital data composed of one status byte 101 and plural data bytes 102. The MDI message includes a channel message for channel and a system message for all equipment in the system. FIG. 9(*a*) shows the channel message and a channel voice message that transmits play information to an electronic instrument. In the channel message, the lower four bits in the status bytes 102 represent an address indicating a channel (hereinafter simply referred to as a channel). In this channel voice message, the data bytes 102 represent audio data. The channels indicate control channels for independently controlling a plurality of electronic instruments in the MDI system, and as shown in FIG. 9(*b*), there are sixteen channels. In the MDI system, the plurality of electronic instruments are independently controlled. Here, for example, a drum, synthesizer, piano, and bass are allocated to channels 1 to 4, and channels 5 to 16 are empty. Audio data is composed of volume data 104 representing volume of sound, time data 105 representing continuation time of sound, and tone data 106 representing tone of sound. A plurality of music pieces composed of arrangement of the MIDI messages are stored in the CD-ROM 54.

Meanwhile, the microcomputer 52 is connected to the operation mode setting unit 47. In accordance with an instruction from the operation mode setting unit 47, the music piece is selected, and in accordance with the installed MDI sequence soft, the CD-ROM drive 53 is operated. Thereby, the MDI messages are sequentially read out from the CD-ROM 54 and sequentially output as the MDI signals. The output MDI signals are input to the massaging operation allocating circuit 56 and the audio signal converting circuit 57 through the MDI interface 55. The massaging operation allocating circuit 56 has a decoding circuit 59 and a signal-switching circuit 60. The decoding circuit 59 is, for example, composed of a DSP (Digital Signal Processor) and is configured to divide the MDI signal input through the MDI interface 55 into a MDI system control signal composed of the status byte 101 (hereinafter referred to as a MDI control signal) and the audio signal composed of the data bytes 102 and decode (demodulate) these signals into analog signals. The signal-switching circuit 60 includes a multiplexer corresponding to a massaging operation for each channel. The operation mode setting unit 47 is configured to set a table showing correspondence between the channels and the massaging operations shown in FIG. 9(*b*). By comparing the MIDI control signal input together with the audio signal with reference to the set correspondence table, the audio signal is allocated to the corresponding massaging operation. Here, the audio signals of the channels 1 to 3, i.e., the audio signals of a drum, synthesizer, and piano are allocated to a tapping operation, a kneading operation, and a vibration operation, respectively, and the audio signal of the channel 4, i.e., the audio signal of the bass is not allocated to any massaging operation. If another content is set in the correspondence table by the operation mode setting unit 47, then the audio signals are allocated according to the newly set content. That is, transmission paths of the audio signals are switched.

The audio signals allocated to the massaging operations are input to the control signal converting circuit 58 and converted into control signals for the drive circuits (hereinafter simply referred to as control signals). The control signal converting circuit 58 is configured to set the correspondence table containing components of the MDI signal and components of the control signal shown in FIG. 9(*c*) by the operation mode setting unit 47. The control signal converting circuit 58 is configured to convert the audio signals into the control signals so that the components of the audio signals correspond to the components of the control signals according to the set correspondence table. Here, as shown in FIG. 9(*c*), the volume data and time data of the MIDI signal correspond to voltage and time of the control signal, respectively, and the tone data of the MDI signal does not correspond to any component of the control signal. As a matter of course, the operation mode setting unit 47 may be operated to set the table in such a manner that the tone and time of the MDI signal correspond to the tone and time of the control signal, respectively, and the volume of the MIDI signal does not correspond to any component of the control signal.

Then, thus converted control signals are input to the drive circuits 43, 44, and 45 corresponding to the massaging operations, and in accordance with the control signals, the motors 10, 11, and 5*a* are driven.

The motors 10, 11, and 5*a* are each comprised of a D.C. motor. The drive circuits 43, 44, and 45 are each comprised of a variable speed drive unit of the D.C. motor. That is, the variable speed drive unit has a power converter comprised of a semiconductor switching device and connected on an input side to a power source, and a control circuit comprised of a data processing element such as an IC or a microprocessor, for controlling ON and OFF of the semiconductor switching device. The D.C. motor is connected to an output side of the power converter.

Upon the control signal having the above voltage and continuation time of the voltage being input to the control circuit, the control circuit controls an ON period (continuity period) of the semiconductor switching device of the power converter according to the voltage of the control signal. Thereby, a D.C. voltage corresponding to the voltage of the control signal is applied to the D.C. motor, which rotates at a speed according to the D.C. voltage. As the variable speed drive unit, a thyristor Leonard type, a chopper type, or the like, may be used, for example. Alternatively, the variable speed drive unit may be configured by a dedicated circuit.

The audio signal converting circuit 57 is comprised of a so-called MIDI sound source. As used herein, the sound source refers to a source that generates the audio signal and corresponds to the CD-ROM drive 53 in the MIDI system. To distinguish between them, the MIDI sound source is called the audio signal converting circuit 57. The audio signal converting circuit 57 has sixteen electronic instruments (only sound sources) corresponding to channels 1 to 16 and mixers connected to these electronic music instruments. Here, the MIDI signals are sequentially input to the drum, the synthesizer, the piano, and the bass, respectively corresponding to the channels 1 to 4 and converted into audio signals, i.e., stereo analog audio signals of L channel and R channel, which are output. The audio signals output from the drum, the synthesizer, the piano, and the bass are composited into one audio signal by the mixer and output to the speaker 27.

Since the other configuration of the massaging apparatus of this embodiment is identical to that of the massaging apparatus of the first embodiment, and will not be further described.

Next, an operation of the massaging apparatus 1 so configured will be described.

The user sits on the base 1*a* of the massaging apparatus 1*b*. First of all, the user inserts a desired CD-ROM 54 into a slot of the CD-ROM drive 53. Then, the operation mode setting unit 47 is operated to select a desired music piece and operation mode. Then, the user pushes a start button.

In response to this, in the massaging apparatus 1*b*, the microcomputer 52 drives the CD-ROM drive 53 to play back the music piece selected by the operation mode setting unit 47. The MIDI signals output by playback of the music piece are input to the decoding circuit 59 and the audio signal converting circuit 57 through the MIDI interface 55.

The audio signal converting circuit 57 converts and composites the input MIDI signals, and outputs the audio signal. The audio signal is input to the speaker 27 and converted into audio, which is listened to by the user.

Meanwhile, the decoding circuit 59 divides the input MIDI signals into the MIDI control signals and the audio signals and decodes these signals, which are input to the signal-switching circuit 60. When the MIDI control signals and the audio signals are input, the signal-switching circuit 60 allocates the audio signals to the massaging operations according to the MIDI control signals and outputs these signals to the corresponding signal paths. The control signal converting circuit 58 converts the audio signals into the control signals so that the components of the audio signals correspond to predetermined components of the control signals and outputs the control signals to the drive circuits 43, 44, and 45. Upon the control signals being input, the drive circuits 43, 44, and 45 output D.C. voltages according to the control signals to the motors 10, 11, and 5*a*, respectively. The motors 10, 11, and 5*a* rotate at speeds according to the voltages and, according to the rotation, the massaging mechanisms 4 and 5 perform predetermined massaging operations. Specifically, the massaging operation of tapping, kneading, and vibration are carried out correspondingly to sounds of the drum, the synthesizer, and the piano of the music piece. During this operation, the speed of each massaging operation varies according to dynamics of the sound of each musical instrument.

With the above configuration, while listening to the selected music piece through the speaker, the user feels massaging operations of tapping, kneading, and vibration that operate at varying speeds according to variation in sounds of the drum, the synthesizer, and the piano of the music piece When the operation mode setting unit 47 is operated so that the tone of the MIDI signal corresponds to the voltage of the control signal as shown in FIG. 9(*d*), the speed of the massaging operation varies according to the high and low of the sound of each musical instrument. Further, the operation mode setting unit 47 may be operated so that a correspondence between the musical instruments and the massaging operations in FIG. 9(*b*) is changed.

Thus, the user feels various massaging operations according to the music.

Figure 10:
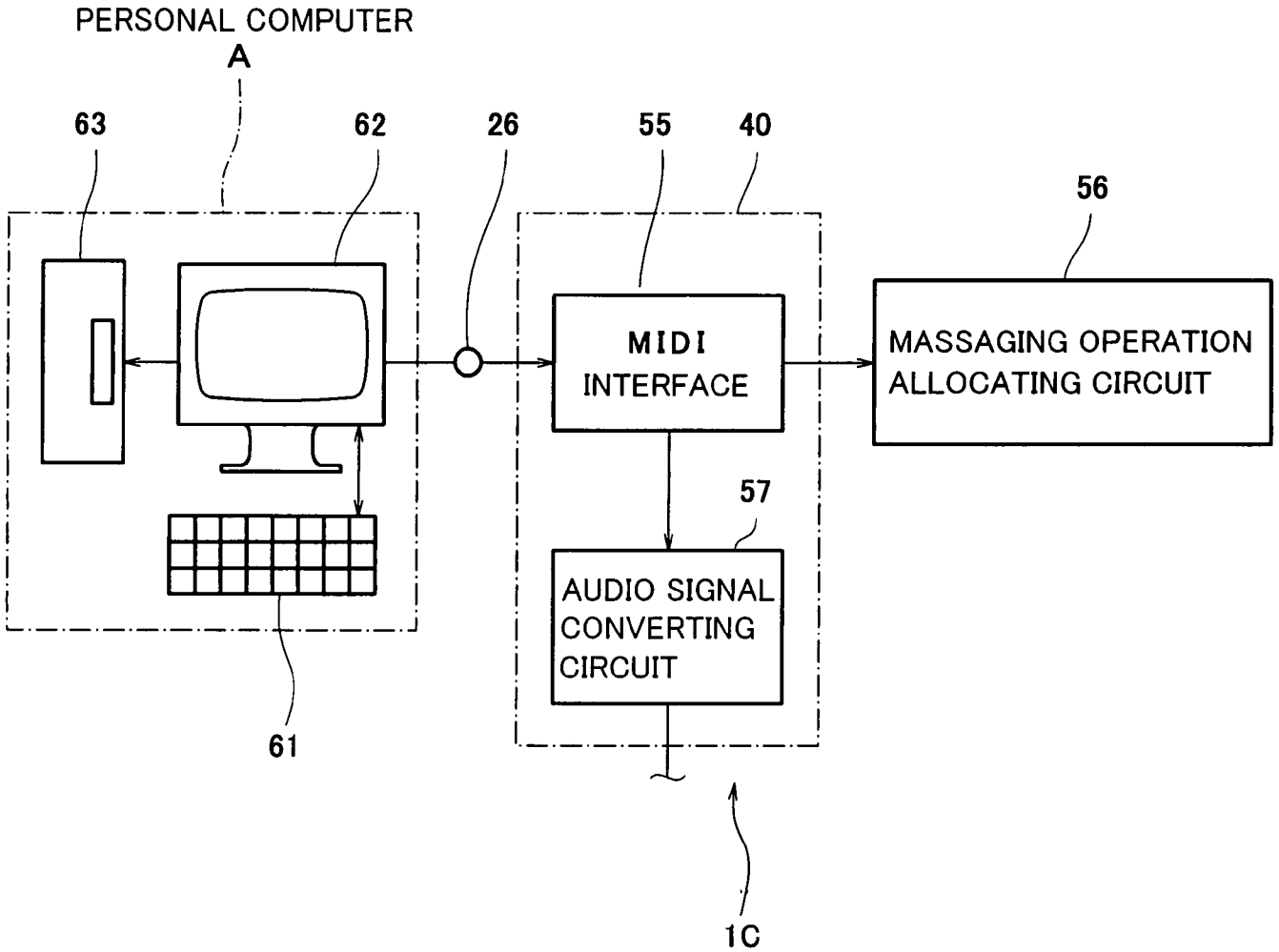
FIG. 10 is a block diagram showing a configuration of a control system when using an external MIDI sequencer.
Figure 11:
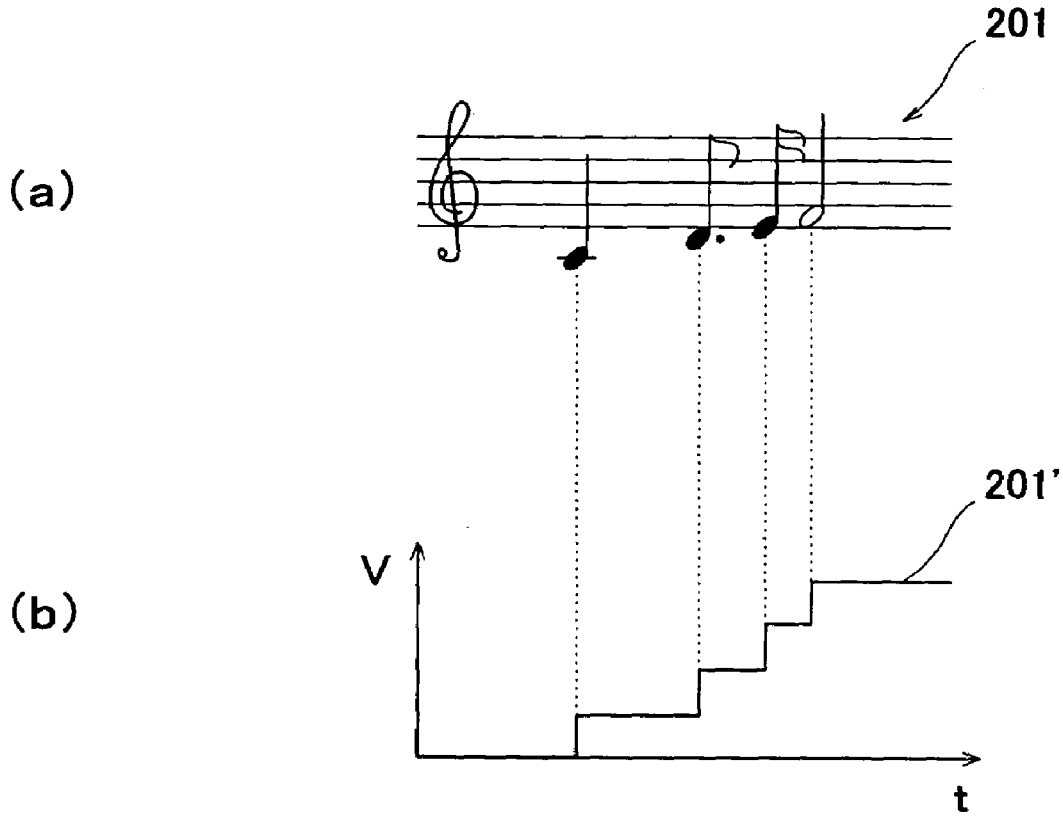
FIG. 11 is a view showing a method of creating a control program of a massaging operation while composing listening appreciation music, wherein FIG. 11(*a*) is a view showing a musical score and FIG. 11(*b*) is a view showing a voltage of a motor.

Next an alternative example of this embodiment will be described. FIG. 10 is a block diagram showing a configuration of a control system when using an external MIDI sequencer. FIG. 11 is a view showing a method of creating a control program of a massaging operation while composing a listening appreciation music piece, wherein FIG. 11(*a*) is a view showing a musical score and FIG. 10(*b*) is a view showing a voltage of a motor.

This alternative example illustrates that, by programming the massaging operation by using the external sound source, a massaging apparatus 1*c* is operated as desired. This applies to a case where a suitable audio-sensible program is developed in a development stage of the massaging apparatus, a case where a user needs a dedicated audio-sensible program for business purposes, a case where the user's desire to feel the audio-massage using the program exclusively for the user is satisfied, etc.

As shown in FIG. 10, in this alternative example, the massaging apparatus 1*c* is configured such that a MIDI interface 55 is connected to an input terminal 26, and its subsequent stage is configured in the same manner as in FIG. 8. Meanwhile, a sound source A is a personal computer A comprising an input device 61 such as a keyboard, a display device 62, and an external storage unit 63 such as a hard disc drive. The personal computer A is connected to the input terminal 26. The operation mode setting unit 47 is not connected to the personal computer A. The music piece is not selected by the operation mode setting unit 47 but by operation of the personal computer A.

Referring to FIGS. 10 and 11, in order to create the control program, for example, DTM (desktop music) soft is run in the personal computer A, thereby causing the musical score to be displayed on the display device 62 as shown in FIG. 11(*a*). Then, by operating the input device 61, musical notes are written onto the musical score. The MIDI message shown in FIG. 9(*a*) is created as corresponding to the written musical notes. Here, it is assumed that the tone corresponds to the voltage of the control signal; that is, the voltage of the motor, as shown in FIG. 9(*d*). In this case, as shown in FIG. 11(*b*), the tone and length of the musical note correspond to a voltage 201' of the motor and time axis. By performing a predetermined operation on the personal computer A, the sound corresponding to the musical note is output from the speaker 27 of the massaging apparatus 1*c*. According to the musical note, the massaging apparatus 1 operates. Therefore, the music is composed and programming is performed while checking the sound of the music to be composed and the operation of the massaging apparatus 1*c* to be programmed. In accordance with this method, the programming is audiovisually performed and, therefore, anybody can create the control program. The above process relates to one musical instrument. The above operation is performed for all the musical instruments (here four instruments), and when the programming (composing) is finished, the personal computer A is operated to allow the music piece to be stored in an external storage unit 63. When the massaging is performed using the control program, the user operates the personal computer A as the MIDI sequencer to select the associated music piece. So, the personal computer A reads out the music piece from the external storage unit 63 and sends it to the input terminal 26. The massaging apparatus 1*c* operates in the same manner as described above. Thereby, the user appreciates a music-sensible massage according to a desired control program.

Subsequently, another alternative example will be described. In the above alternative example and embodiment, the music to be listened to by the user coincides with the music to be used for controlling the massaging operation while, in this alternative example, the music to be listened to by the user is made different from the music to be used for controlling the massaging operation. Specifically, the music to be used for controlling the massaging operation is a control program using musical notes and is not intended to produce musical effects. Therefore, such music should not be listened to by the user. Accordingly, a music piece for listening appreciation is allocated to the channels 1 to 4 in the above embodiment, and the control program is allocated to the other empty channels. In FIG. 10, control is executed so that only the MIDI messages of the channels of the music piece (channels 1 to 4) are delivered to the audio signal converting circuit 57 and only the MIDI messages of the channels for the control program are delivered to the massaging operation allocation circuit 56. This control is executed by delivering predetermined MIDI messages for control from the personal computer A as the MIDI sequencer.

Figure 12:
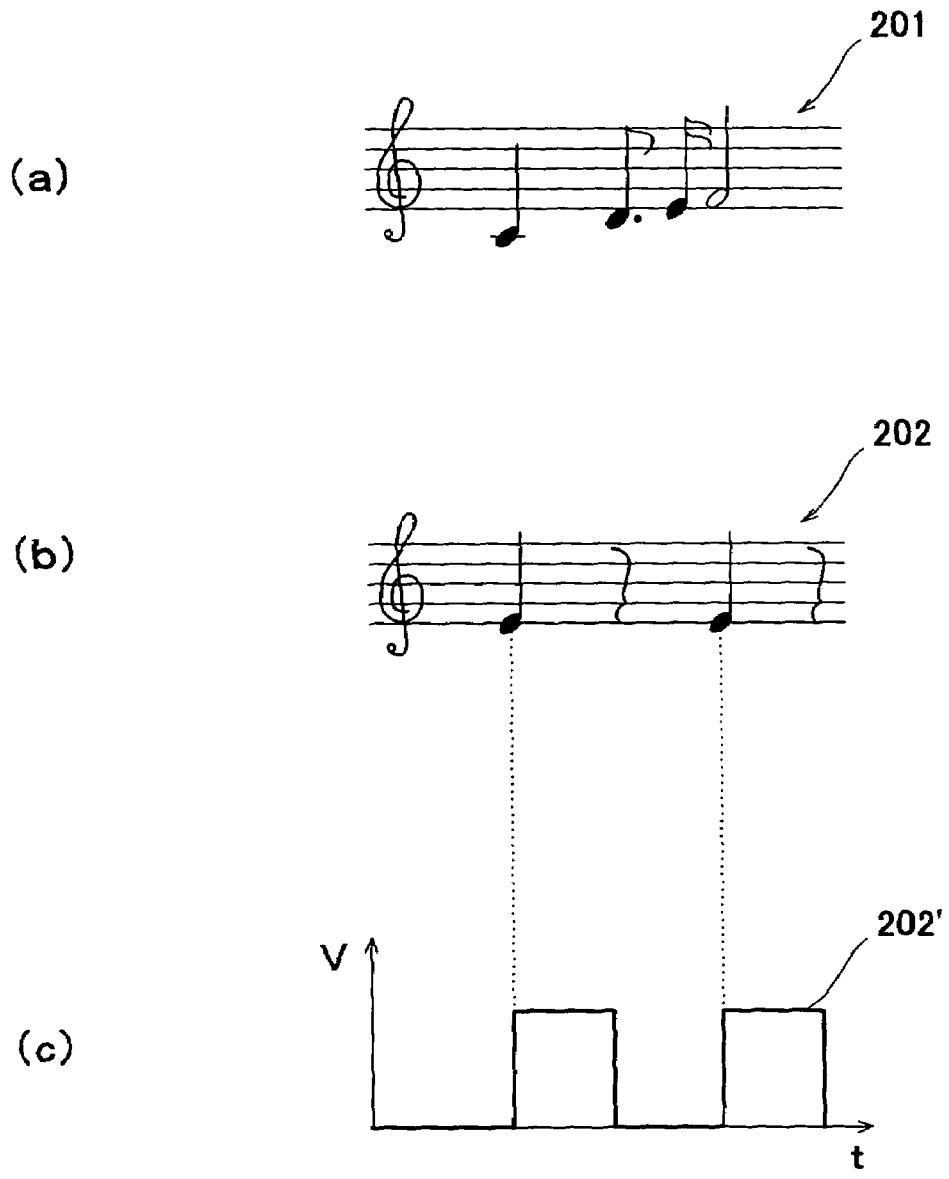
FIG. 12 is a view showing a method of creating a control program of a massaging operation using a musical score, wherein FIG. 12(*a*) is a view showing a musical score of listening appreciation music, FIG. 12(*b*) is a view showing a musical score for a control program, and FIG. 12(*c*) is a view showing a motor voltage.

Subsequently, a method of creating the control programs will be described. FIG. 12 is a view showing a method of creating the control program of the massaging operation using musical scores, wherein FIG. 12(*a*) is a view showing a musical score of listening appreciation music, FIG. 12(*b*) is a view showing a musical score for the control program, and FIG. 12(*c*) is a view showing a voltage of a motor.

Referring to FIG. 12, in order to create the control program, a musical score 201 for listening appreciation music and a musical score 202 for the control program are arranged and displayed on a screen of the display device 62. The musical score 202 for the control program is created while the musical score 201 of listening appreciation music is checked. A voltage 202' of the motor corresponding to the musical score 202 for control program is shown in FIG. 12(*c*). In this case, it is preferable that the voltage 202' of the motor has a relatively long cycle in the control program as shown in FIG. 12(*c*). This is because response delay due to inertia, backrush, or the like of the motor and the massaging mechanism exists in the drive system of the massaging mechanism and, therefore, the massaging operation does not conform to variation in the voltage of the motor in a short cycle. It should be appreciated that, as shown in FIG. 9(*c*), the volume may correspond to the voltage of the motor and, in that case, the control program can be created in the same manner as described above.

In accordance with this alternative example, since the control program of the massaging operation is created in advance according to the music to be listened to by the user, the user feels massaged according to the music. In addition, since the user is massaged in synchronization with the music, the user is massaged comfortably according to the tempo of music and rise and fall of the music, while listening to the music.

Figure 13:
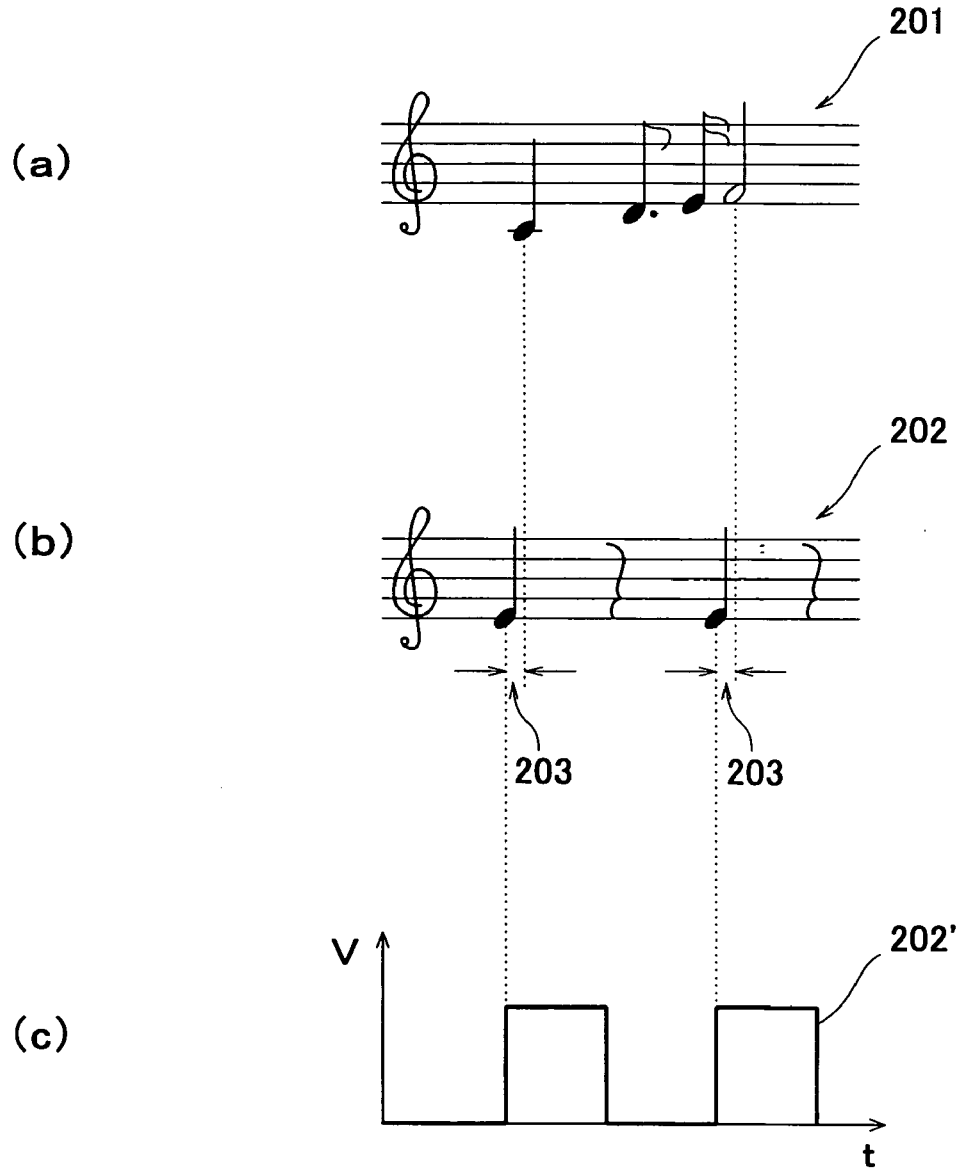
FIG. 13 is a view showing an example of measures against delay of a massaging operation, wherein FIG. 13(*a*) is a view showing a musical score for listening appreciation music, FIG. 13(*b*) is a view showing a musical score for a control program, and FIG. 13(*c*) is a view showing a voltage of a motor.

Subsequently, measures against delay of the massaging operation will be described. FIG. 13 is a view showing an example of the measures against delay of the massaging operation, wherein FIG. 13(*a*) is a view showing a musical score of listening appreciation music, FIG. 13(*b*) is a view showing a musical score for a control program, and FIG. 13(*c*) is a view showing a voltage of a motor.

When the delay of the massaging operation is represented by numeric values, delay time of an operation of the kneading head of the massaging element, which occurs in application of a step voltage to the motor for the massaging mechanism 4 is about 20 ms, and delay time until the user seated in the massaging apparatus 1*c* feels the operation of the massaging head is 40 ms. Accordingly, in this measure, as shown in FIG. 13, a position of a musical note of a control program is advanced by predetermined time 203 with respect to that of the listening appreciation music on time axis, allowing for the delay. Here, the predetermined time 203 is about 40 ms. This compensate for the delay of the massaging operation, so that the massaging is carried out according to the tempo of music.

Figure 14:
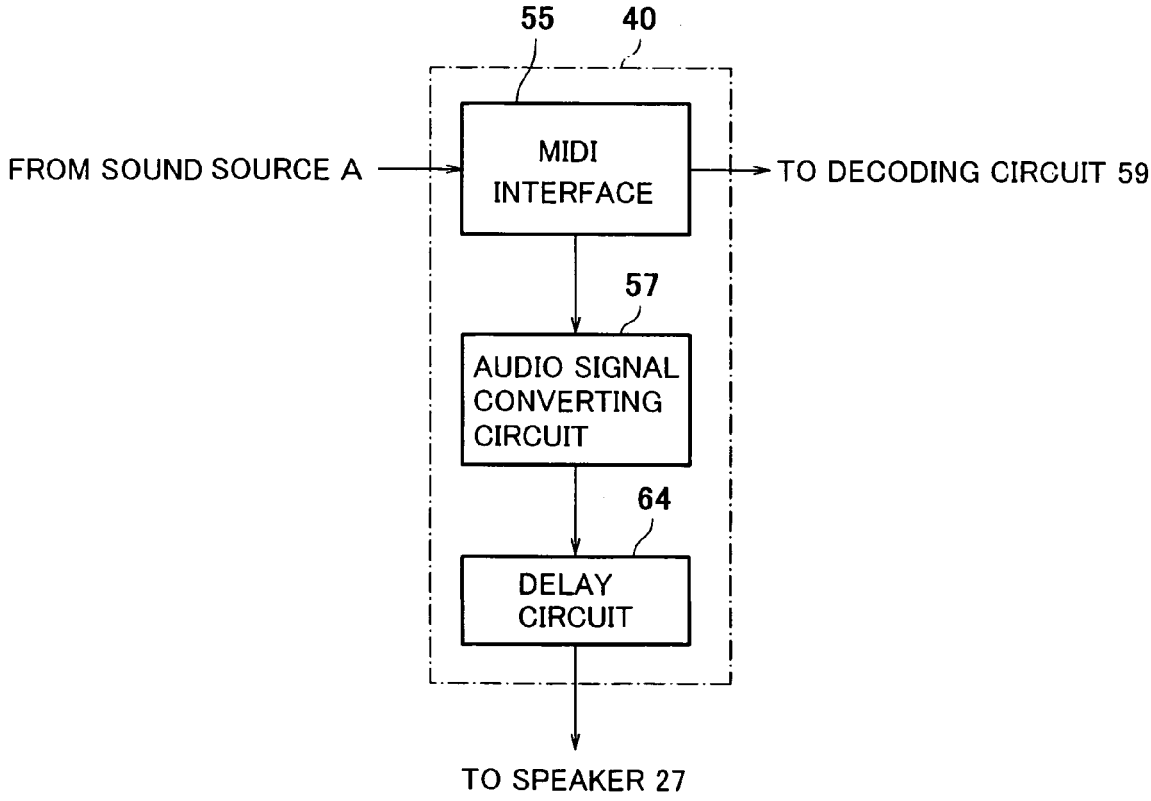
FIG. 14 is a block diagram showing another example of measures against delay of a massaging operation.

FIG. 14 is a block diagram showing another example of the measures against delay of the massaging operation. As shown in FIG. 14, in this measure, a delay circuit 64 is provided in a subsequent stage of the audio signal converting circuit 57 to delay the audio signal output from the audio signal converting circuit 57 by a predetermined time. This predetermined time is about 40 ms. This also compensates for a delay of the massaging operation, and the massaging is carried out according to the tempo of music.

As a matter of course, the configuration for using the listening appreciation music and the music for the control program according to purposes and the configuration relating to the measures against delay of the massaging operation are applicable to the massaging apparatus 1B that contains the sound source A in FIG. 7.

Embodiment 3

Figure 15:
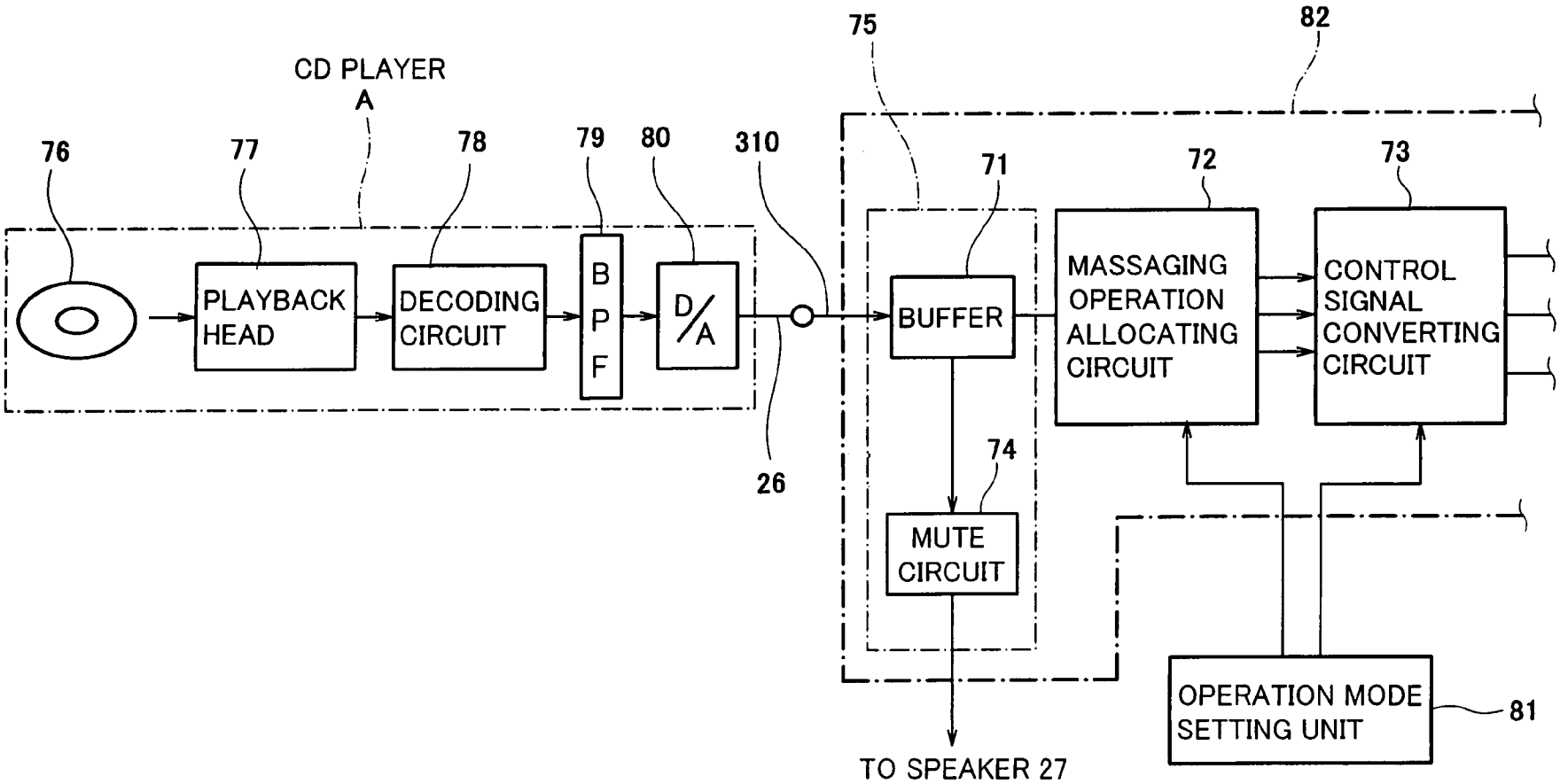
FIG. 15 is a block diagram showing a configuration of a control system of a massaging apparatus according to a third embodiment of the present invention.
Figure 16:
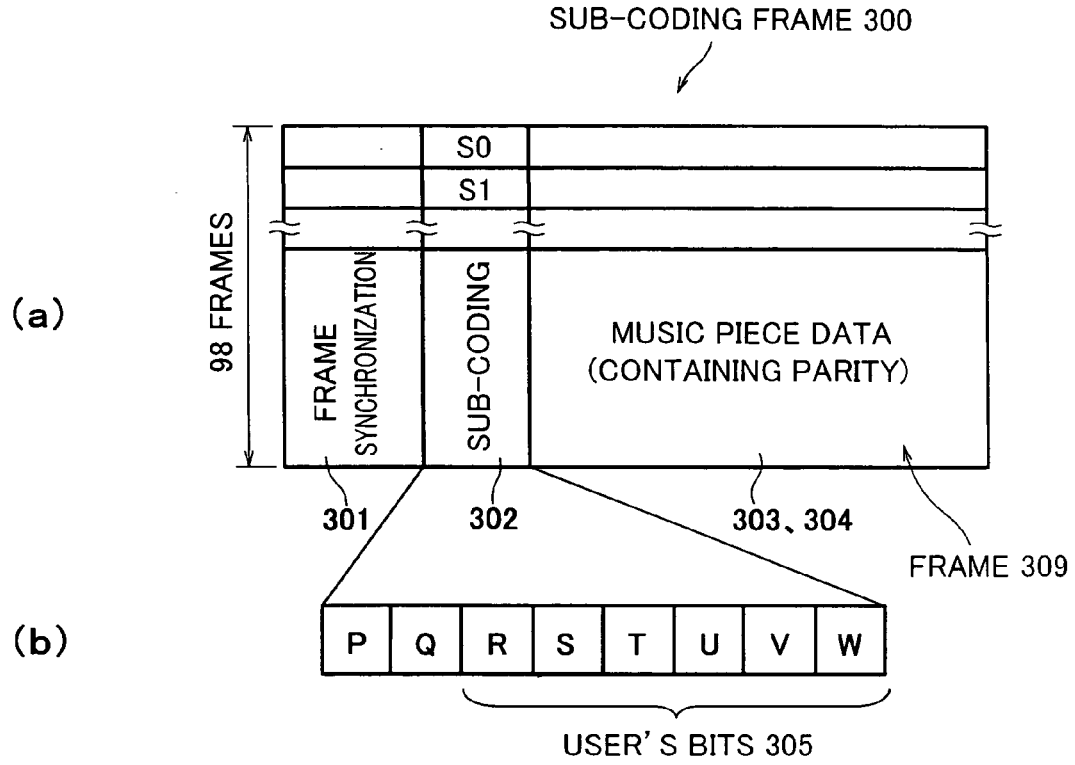
FIG. 16 is a schematic view showing a structure of audio data stored in a CD in FIG. 15, wherein FIG. 16(*a*) is a view showing the entire audio data, FIG. 16(*b*) is a partially enlarged view of music piece data and sub-coding in the audio data in FIG. 16(*a*), and FIG. 16(*c*) is a table representing meanings of codes.
Figure 17:
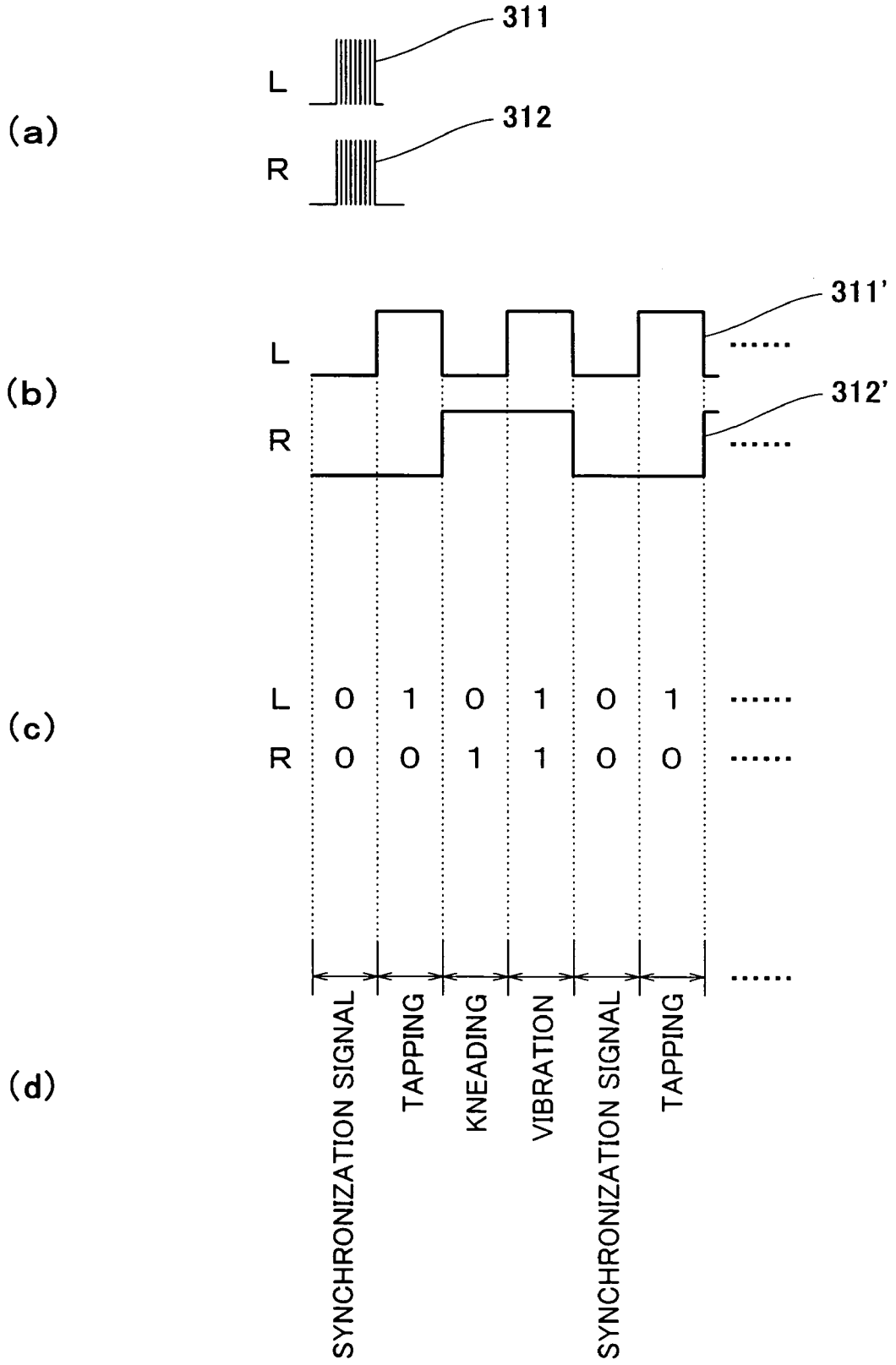
FIG. 17 is a view showing a process of a control program signal stored in the CD in FIG. 15, wherein FIG. 17(*a*) is a view showing a demodulated control program signal, FIG. 17(*b*) is a view showing an expanded control program signal, and FIGS. 17(*c*) and 17(*d*) are views showing a correspondence between values of the control program and massaging operations.

FIG. 15 is a block diagram showing a configuration of a control system of a massaging apparatus according to a third embodiment of the present invention and FIG. 16 is a schematic view showing a structure of audio data stored in a CD, wherein FIG. 16(*a*) is a view showing the entire audio data, FIG. 16(*b*) is a partially enlarged view of sub-coding of audio data, and FIG. 16(*c*) is a table that represents the meanings of codes. FIG. 17 is a view showing a process of the control program stored in the CD in FIG. 15, wherein FIG. 17(*a*) is a view showing a demodulated control program signal, FIG. 17(*b*) is a view showing an expanded control program signal, and FIGS. 17(*c*) and 17(*d*) are views showing a correspondence between values of the control program signal and massaging operations. In FIG. 15, the same reference numerals as those in FIGS. 7 and 8 denote the same or corresponding parts.

As shown in FIG. 15, in this embodiment, a CD player is used as the sound source A as an external sound source. Specifically, a massaging apparatus 1*d* has an input terminal 26 to which a buffer 71 is connected, and a massaging operation allocating circuit 72 and a control signal converting circuit 73 which are specified for this embodiment are connected in series to the buffer 71. An operation mode setting unit 81 is connected to the massaging operation allocating circuit 72 and the control signal converting circuit 73, and is configured to set operation modes (operation patterns) of the massaging apparatus 1*d* as mentioned later. A mute circuit 74 is connected to the buffer 71 and an output of the mute circuit 74 is input to a speaker 27. The buffer 71 and the mute circuit 74 configure a branching circuit 75. A control device 82 is configured by the branching circuit 75, the massaging operation allocating circuit 72, the control signal converting circuit 73, and the like. In the other respects, the massaging apparatus 1*d* is identical to the massaging apparatus 1*b* in FIG. 8.

The CD player A is well-known. A CD 76 that contains digital audio data is loaded in the CD player A and driven. Audio data is read from the CD 76 by a playback head 77, and the read audio data is decoded by a decoding circuit 78. The decoded audio data pass through a band pass filter 79 and is converted into analog data by a D/A converting circuit 80 and the resulting analog signal is output. The analog audio signal output from the CD player A is a stereo audio signal 310 of L channel and R channel. The audio signal 310 is output from so-called audio terminal. The audio signal 310 is input to the input terminal 26.

The CD 76 is a specific CD. Referring to FIGS. 15 and 16, digital audio data (frame) 309 is stored in the CD 76. The frame 309 is obtained by sampling a series of audio signals at predetermined intervals and quantizing the audio signals and by coding them. Data stream comprising 98 frames 309 on a time axis composes a sub-coding frame 300, and a data stream comprising a predetermined number of sub-coding frames 300 composes one music piece. The frame 309 is composed of a frame synchronization code 301, a sub-coding 302, and music piece data 303 in this order from the head. The frame synchronization code 301 serves to establish synchronization between the frames 309. The sub-coding 302 is composed of 8 bits of P to W, among which lower 6 bits of R to W are used freely by the user. In first two sub-coding frames 300, bits S are allocated to codes S0 and S1 to establish synchronization between sub-coding frames 300. Here, the user's bits are not used. A bit P is used as a boundary bit between a music piece and another music piece. A bit Q is used to represent a music piece number, lapse time, or the like, for every 98 frames. This is the reason why a unit of 98 frames is called the sub-coding frame 300. The music piece data 303 is quantized and coded music (a music piece), and music piece data 303 of a predetermined number of frames 309 from head of individual music piece is composed of control program data 304 of the massaging operation. In this respect, the CD 76 is different from a normal CD. The music piece data 303 (304) contains parity for error correction.

Referring to FIGS. 16 and 17, the control program data 304 is obtained by compressing square-wave signals in FIG. 17(*b*) (i.e., digital signal) in a predetermined ratio (e.g., in the order of 1/100 to 1/1000) and by adding the compressed signals to the heads of the audio signals of individual music pieces, and by sampling, quantizing, and coding the resulting signals together.

Therefore, control program signals 311 and 312 comprising compressed square waves shown in FIG. 17(*a*) are added to the heads of the audio signals decoded and converted into analog by the CD player A. For the purpose of removing noises generated in demodulating the digital audio signals, the CD player A is typically provided with a band pass filter 79 to allow only the audible frequency band of human beings, i.e., the frequency band between 20 Hz and 20 KHz to pass therethrough. Since the signal with a frequency outside this range is not taken out, the demodulated control program signals 311 and 312 have a frequency of 1 KHz, for example (to be precise, clock frequency). A square wave with this frequency can pass through the band pass filter 79 although its waveform is not sharp. The buffer 71 is comprised of, for example, DSP. Upon the audio signals with the control program signals 311 and 312 being input, the added control program signals 311 and 312 are separated from the music pieces and are temporarily stored in an internal memory. The control program signals 311 and 312 are digital signals and therefore are stored in the internal memory. The stored control program signals 311 and 312 are input to the massaging operation allocating circuit 72 at timings according to start of the music pieces of the audio signals. Meanwhile, the input audio signal is directly input to the mute circuit 74. The mute circuit 74 outputs the input audio signal to the speaker 27 although it does not output the audio signal during the continuation time of the control program signal. Thereby, the user does not listen to sound generated by the control program signal. Delay occurs between the time when the CD 76 starts playback and the time when the speaker 27 makes a sound because of the presence of the control program signal. But, the continuation time of the control program signal is about 10 seconds and, therefore, the user does not feel discomfort.

On other hand, the massaging operation allocating circuit 72 expands the input control program signals 311 and 312 in the predetermined ratio to restore them to their original lengths. The control program signals 311' and 312' having original lengths are created according to the corresponding music pieces. Therefore, they are almost equal in length to the corresponding music pieces and are in synchronization with them. As shown in FIG. 17(*b*), the control program signal 311' of L channel and the control program signal 312' of R channel represent binary numbers. The signals 311' and 312' vary between two levels, low and high. By associating "0" and "1" with low level and high level, a combination of these represent binary numbers. Using the binary numbers, for example, the massaging operations are allocated as shown in FIGS. 17(*c*) and 17(*d*). That is, specifically, periods of "00," "10," "01," and "11" correspond to "synchronization signal," "tapping operation," "kneading operation," and "vibration operation," respectively. Thereby, over the periods in FIG. 17(*d*), "tapping operation," "kneading operation," and "vibration operation" are sequentially carried out. Therefore, during the period of "synchronization signal," no massaging operation is performed and, while one massaging operation is performed, the other massaging operation is not performed. The correspondence between the binary numbers and the massaging operations can be set by the operation mode setting unit 81. For example, the "vibration operation" may be replaced by the "kneading operation and tapping operation." Alternatively, the above three massaging operations may be suitably combined. An allocation signal of the massaging operation is input to the control signal converting circuit 73, which outputs the control signal based on the input signal. The control signal is generated so that an operating period of each massaging operation conforms to the input signal and the operating pattern conforms to the pattern set by the operation mode setting unit 81.

Subsequently, an operation of the massaging apparatus 1*d* so configured will be described.

Referring to FIGS. 15 to 17, loading the CD 76 on the CD player A, the user selects a desired music piece and turns on a start button. In response to this, frames 309 of the music piece with the control program are sequentially read out from the CD 76 and decoded and converted into analog. The analog audio signal 310 is input to the buffer 71 of the massaging apparatus 1*d* through an audio terminal (not shown) of the CD player A. The buffer 71 temporarily stores the control program signal located in front of the audio signal 310 and inputs the control program signal to the massaging allocating circuit 72 according to start of the music piece, while the input audio signal 310 is input to the mute circuit 74. The mute circuit 74 outputs the input audio signal to the speaker 27, although it does not output the input audio signal during the continuation time of the control program signal. Thereby, sound of the selected music piece is sent from the speaker 27 to the user with sound of the control program signal removed.

Meanwhile, the massaging operation allocating circuit 72 expands the input control program signals, allocates the operating periods of the massaging operations based on the control program signals, and inputs the allocation signal to the control signal converting circuit 73. The control signal converting circuit 73 generates the control signals so that the massaging operations are carried out during periods according to the input allocation signal and pattern set by the operation mode setting unit 81 and outputs the control signals to drive circuits. In synchronization with the selected music piece, the massaging mechanisms 4 and 5 (see FIG. 7) perform operations of tapping, kneading, and vibration at predetermined intervals sequentially.

Thereby, listening to the selected music, the user feels massaged with the massaging operations sequentially performed according to music. The user operates the operation mode setting unit 81 to change the order and operating pattern of the massaging operations. Besides, a transmission line from the CD player A to the branching circuit 75 is configured by a transmission line of normal audio signal, and a general-purpose CD player is used as the external sound source A.

Figure 18:
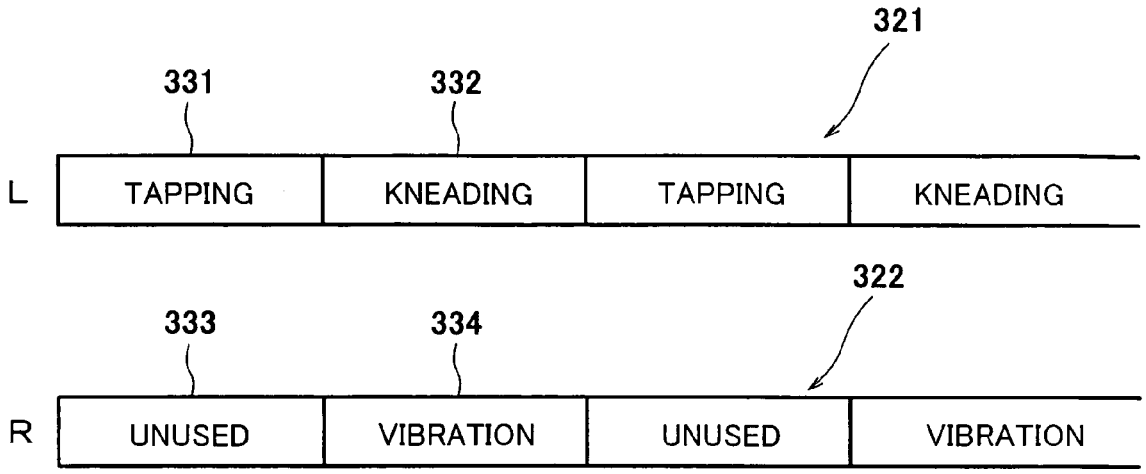
FIG. 18 is a view showing another configuration of the control program, wherein FIG. 18(*a*) is a view showing a data structure of the control program, and FIG. 18(*b*) is a view showing a data structure of each massaging operation.
Figure 18:
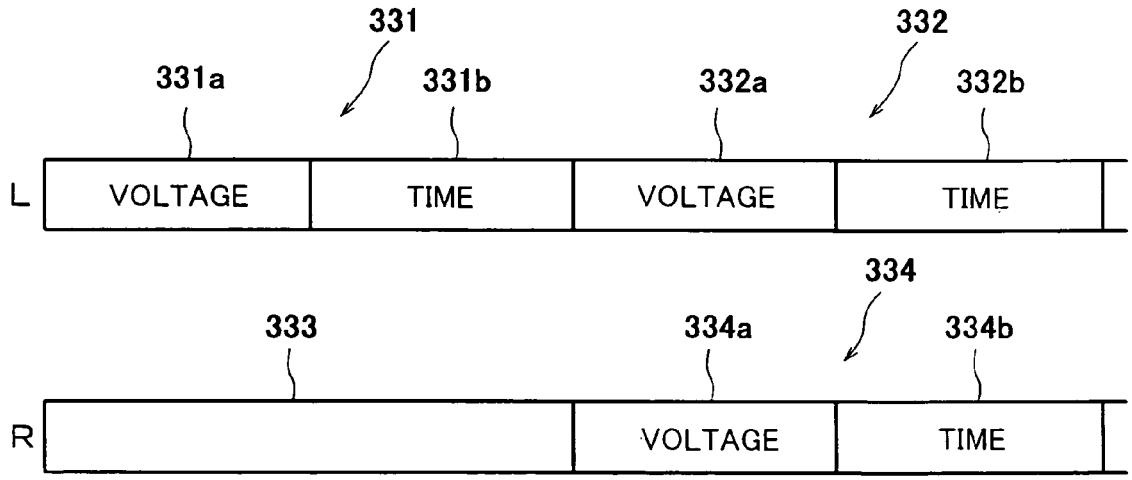

Subsequently, an alternative example of this embodiment will be described. FIG. 18 is a view showing another structure of the control program, wherein FIG. 18(*a*) is a view showing a data structure of the control program and FIG. 18(*b*) is a view showing a data structure of massaging operations. In this alternative example, the control program signal has a data structure shown in FIG. 18(*a*) in an original state in which the signal is decoded, converted into analog and expanded. Control program signals 321 and 322 are composed of square-wave signals shown in FIG. 17(*b*), i.e., digital signals varying between low level and high level. The digital signals are obtained by sampling, quantizing, and coding the analog signals. For example, the control program signal 321 of L channel is composed of tapping data 331 representing the tapping operation and kneading data 332 representing the kneading operation, which are alternately arranged. The control program signal 332 of R channel is composed of unused (empty) data region 333 and vibration data 334 representing the vibration operation, which are alternately arranged. As shown in FIG. 18(*b*), the tapping data 331 is composed of voltage data 331*a* indicating a voltage of the corresponding motor and time data 331*b* indicating continuation time of the voltage, the kneading data 332 is composed of voltage data 332*a* indicating a voltage of the corresponding motor and time data 332*b* indicating continuation time of the voltage, and the vibration data 334 is composed of voltage data 334*a* indicating a voltage of the corresponding motor and time data 334*b* indicating continuation time of the voltage. The control signals 321 and 322 are compressed in a predetermined ratio, and added to the heads of the audio signals of individual music pieces. The resulting audio signals are sampled, quantized, and coded to be stored in the CD. In playback, the control program signals are decoded and converted into analog, and the decoded analog control signals are separated from music piece portions and expanded. The control program signals 321 and 322 are longer than the control signals 311 and 312 of the above embodiment because of their complexity. Nonetheless, it is necessary to pass the control signals 321 and 322 through the band pass filter for removing noises which is built in the CD player. Accordingly, in this alternative example, the frequency and length of each of the control program signals 321 and 322 are set to several KHz and several tens seconds, respectively. The control program signals 321 and 322 with such frequency can pass through the band pass filter without substantial troubles. Also, the control program signals 321 and 322 with such length do not make the user feel discomfort with respect to delay of audio output from the speaker. Referring to FIG. 15, the expanded digital control program signals are decoded and converted into analog by the massaging operation allocation circuit 72 and output to the control signal converting circuit 73. The following operation is similar to that of the above embodiment. With this configuration, the massaging operations are performed in parallel and set individually. As a result, various massaging operations according to the music are realized.

While in the above embodiment, the audio signal is in stereo, and apparently the audio signal is implemented in a single-channel, i.e., one channel, in the same manner by reducing patterns of the massaging operations in FIGS. 17 and 18.

As a further alternative example, an audio signal having a reduced amplitude (having reduced gain) with a pulse signal alternately having positive and negative values in a predetermined cycle superposed is modulated and stored in the CD 76, and in playback, the resulting signal is demodulated, amplified, and delivered to the speaker 27. And, a control signal may be generated so that on-and-off timing of the motor corresponds to the positive and negative values of the demodulated signal pulse. In this case, the frequency of the pulse is approximately 20 KHz which is within a passing range of the band pass filter 79. With this configuration, without delay of the audio output from the speaker 37 with respect to the start of playback of the CD 76, the general-purpose CD player may be used as the external sound source A.

As a further alternative, the following configuration is possible. The audio signal and the control program signal composed of a pseudo digital signal are respectively quantized, coded, and composited. They are stored as one signal and the other signal of the L channel and the R channel of the audio signal in a general-purpose CD. In playback, they are demodulated and separated. The audio signal of one channel is delivered to the speaker 27 and the control program signal of the other channel is associated with the control signal in the same manner as in the above embodiment. In this case, as the pseudo digital signal, a signal having a waveform in which a sound period with a square wave and a non-sound period without the square wave are alternately arranged, and a pair of the sound period and the non-sound period is handed as one bit, so that the control program signal is associated with the control signal as in the case where a general square wave is used as a digital signal. The frequency of the square wave is approximately 10 KHz which is within a passing range of the band pass filter 79. With this configuration, without delay of the audio output from the speaker 27 with respect to the start of playback of the CD 76, the general-purpose CD player may be used as the external sound source A.

Embodiment 4

Figure 19:
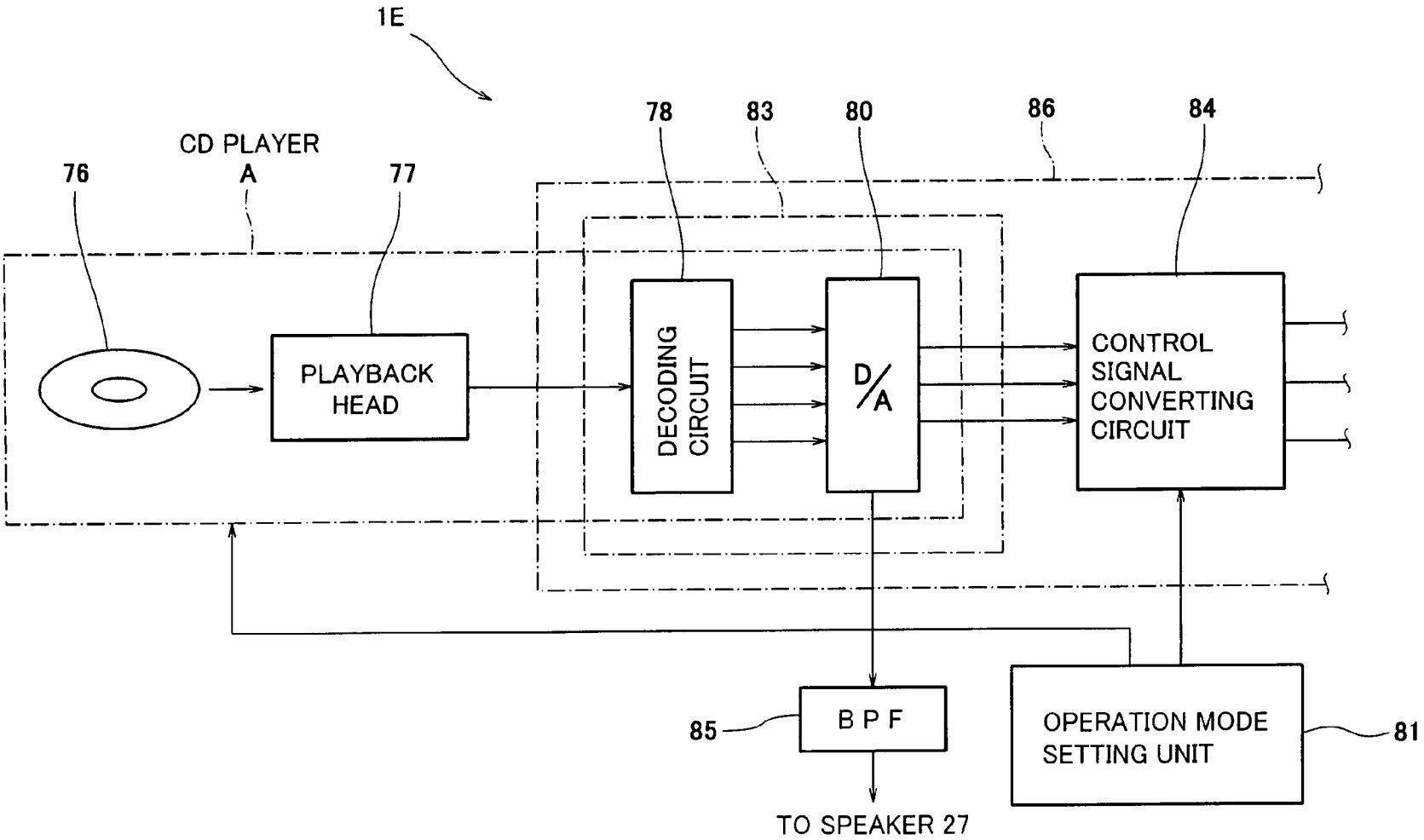
FIG. 19 is a block diagram showing a configuration of a control system of a massaging apparatus according to a fourth embodiment of the present invention.
Figure 20:
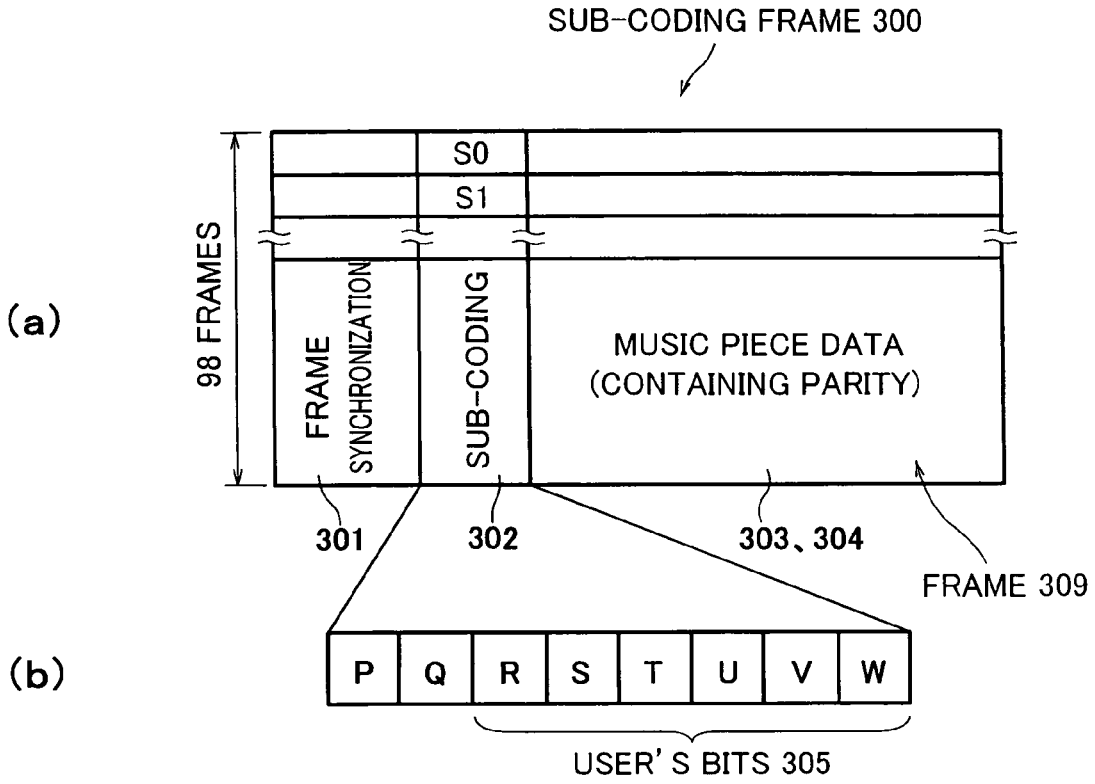
FIG. 20 is a schematic view showing a structure of audio data stored in a CD in FIG. 19, wherein FIG. 20(*a*) shows the entire audio data, FIG. 20(*b*) is a partially enlarged view of music piece data and sub-coding of the audio data in FIG. 20(*a*), and FIG. 20(*c*) is a table representing meanings of codes.
Figure 21:
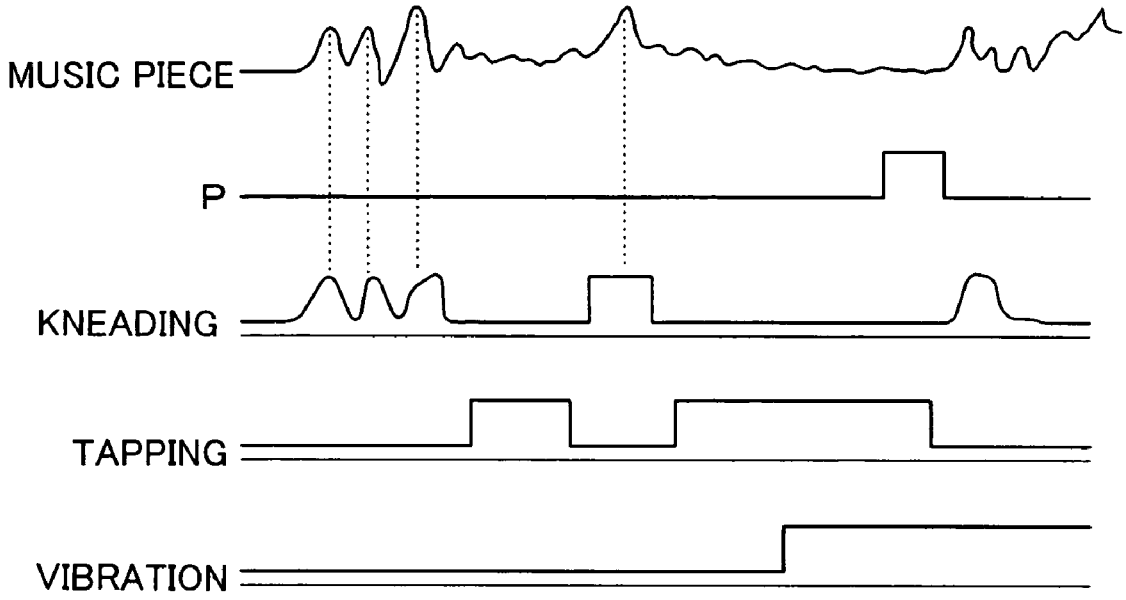
FIG. 21 is a graph showing a correspondence between a music piece stored in the CD in FIG. 19 and the control program.

FIG. 19 is a block diagram showing a configuration of a control system of a massaging apparatus according to a fourth embodiment of the present invention. FIG. 20 is a schematic view showing a data structure of audio data stored in a CD in FIG. 19, wherein FIG. 20(*a*) is a view showing the entire audio data, FIG. 20(*b*) is a partially enlarged view of music piece data and sub-coding of the audio data, and FIG. 20(*c*) is a table showing meanings of codes. FIG. 21 is a graph showing correspondence between the music piece stored in the CD and the control program. In FIGS. 19 and 20, the same reference numerals as those in FIGS. 15 and 16 denote the same or corresponding parts.

In FIG. 19, in this embodiment, the CD player A is built in a massaging apparatus 1*e* according to this embodiment. The CD player A as hardware is provided independently of the body 1*a* of the massaging apparatus 1 in FIG. 1 and these are connected through a wire. A D/A converting circuit 80 of the CD player A is connected to a control signal converting circuit 84 and connected to the speaker 27 through a band pass filter 85. The band pass filter 85 is a filter which passes only a frequency band similar to that of the band pass filter described in the third embodiment and serves to remove noises. By providing the band pass filter 85 at this location, the audio signal whose noises have been removed is supplied to the speaker 27, while the control program signal does not pass through the band pass filter 85. The decoding circuit 78 and the D/A converting circuit 80 configure the branching circuit 83. A control device 86 of this embodiment is provided with the branching circuit 83, the control signal converting circuit 84, and the like. The control signal converting circuit 84 is configured to generate and output the control signal according to the control program signal given from the D/A converting circuit 80. The operation mode setting unit 81 is connected to the control signal converting circuit 84 and the CD player A. The operation mode setting unit 81 enables the turning on and off of the CD player A and selection of the music piece, and instructs the control signal converting circuit 84 to select strength or the like of each massaging operation. In other respects, this alternative example is identical to that of the third embodiment.

As shown in FIG. 20, in this embodiment, a control program is incorporated into user's bits 305 of the frame 309. Specifically, in the user's bits 305, the kneading operation, the tapping operation, and the vibration operation are incorporated into bits R to U, bit V, and bit W, respectively. As shown in FIG. 21, the kneading operation, the tapping operation, and the vibration operation are programmed according to the music piece. In FIG. 21, the amplitude of a curve representing each massaging operation represents a motor voltage, i.e., speed of each operation. The massaging operations are programmed in such a manner that the kneading operation is faster at a high-volume portion of the music piece, the tapping operation is faster at a static portion of the music piece, and the vibration operation is faster at a rear-half portion of the music piece. P represents a boundary between the music piece and another music piece. FIG. 21 shows an initial state, i.e., a demodulated state. The control programs associated with the music piece and the music piece itself are sampled, quantized, coded, and then composited, thereby obtaining the frames 309 in FIG. 20.

Subsequently, an operation of a massaging apparatus 1*e* configured as described above will be described. Referring to FIGS. 19 to 21, the user loads the CD 76 into the CD player A, and selects a desired music piece by the operation mode setting unit 81. Then, the user starts playback. Thereby, the frames 309 of the music piece with the control programs are sequentially read from the CD 76 by a playback head 77 and decoded by the decoding circuit 78. At this time, the music piece is separated from the control program signal of the massaging operations. The separated signals are converted into analog by the D/A converting circuit 80, and the signal representing the music piece is output to the speaker 27 as the audio signal. The signals representing the massaging operations are input to the control signal converting circuit 84 as analog control program signals shown in FIG. 21. The control signal converting circuits 84 generates the control signals so that amplitudes of the input control program signals are associated with motor voltages and outputs the signals to the drive circuits. The following operation is similar to that of the third embodiment. Thereby, the music piece selected by the user is delivered from the speaker 27, while the massaging operations according to the control program created according to the music piece is performed on the user, so that the user feels massaged according to the music. The user operates the operation mode setting unit 81 to select a desired music piece and strength or the like of the massaging operation. While in the above-described setting, the control program signal separated by the decoding circuit 78 is converted into analog by the D/A converting circuit 80, the control program signal in digital form may be directly input to the control signal converting circuit 84 and be associated with the control signals.

Figure 22:
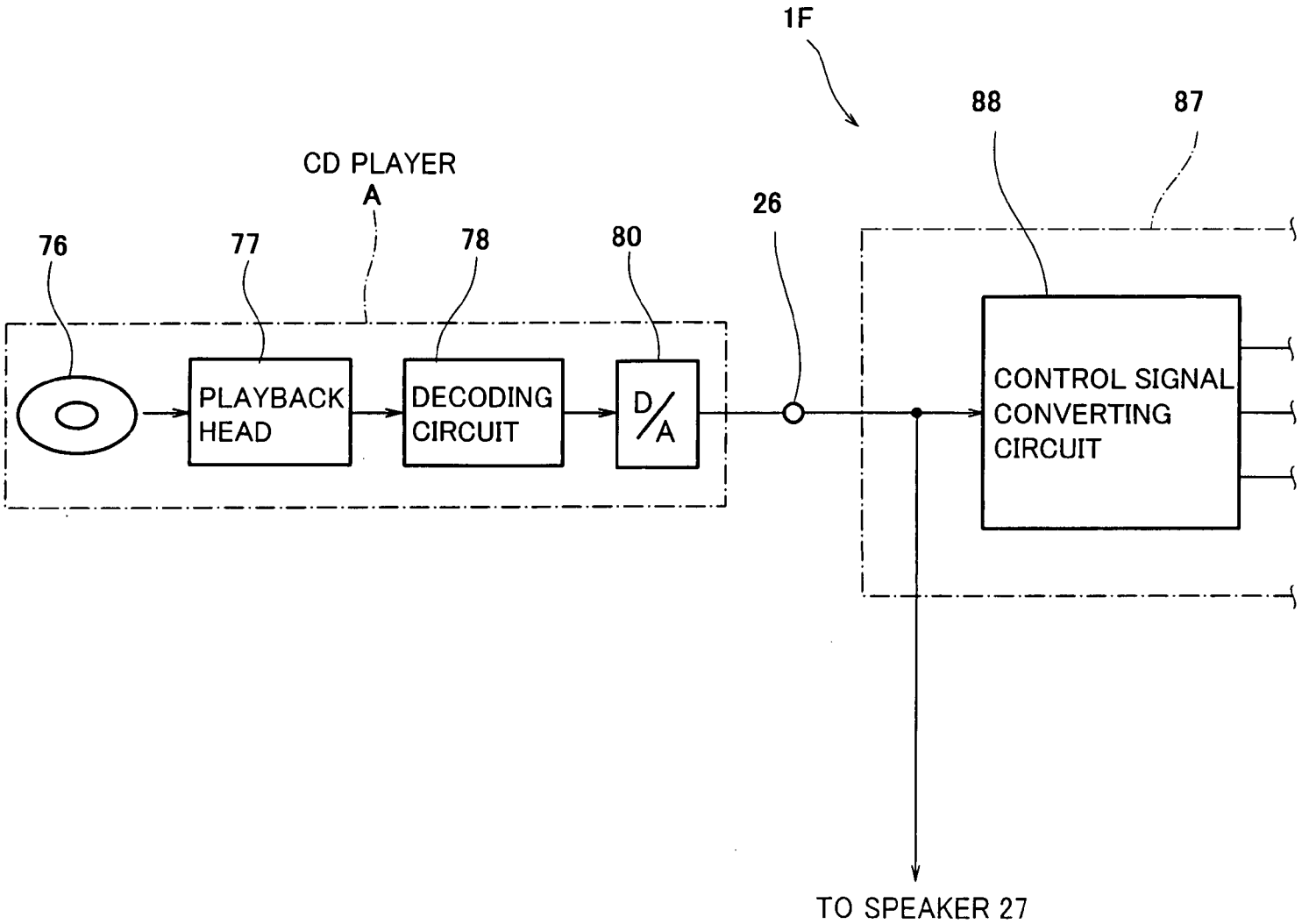
FIG. 22 is a block diagram showing a configuration of a control system in an alternative example of the fourth embodiment of the present invention.

Subsequently, an alternative example of this embodiment will be described. FIG. 22 is a block diagram showing a configuration of a control system of this alternative example. As shown in FIG. 22, in a massaging apparatus 1*f* of this alternative example, a CD player is used as the external sound source A, and an audio signal output from the CD player A is output to the speaker and is directly input to the control signal converting circuit 88 included in a control device 87 of this alternative example. The control signal converting circuit 88 allocates signals of L channel and R channel of the input audio signal to massaging operations and associates components of the signals with components of the control signals. For example, the amplitude of each signal of the L channel and the R channel of the audio signal is associated with a voltage of the control signal. According to the audio signal, i.e., dynamics of the music piece, the speed of the massaging operation varies. In addition, the massaging operations of kneading, tapping, vibration, and the like vary according to the variation in sound of the L channel and the R channel. With this configuration, the user feels various massaging operations according to the music.

As a further alternative example, in FIGS. 19 and 21, the music piece and the control program associated with the music piece in FIG. 21 are stored in separate tracks of the CD 76, and the playback head 77 may read them simultaneously and input them to the decoding circuit 78. With this configuration, the same effects as described in the above embodiment are obtained.

As a further alternative example, as shown in FIG. 19, a control program signal is modulated into a supersonic region and bypasses a noise-removing filter, and the modulated signal is composited with the audio signal and input to the control device 86, where the control program signal is separated from the audio signal and demodulated, and the demodulated signal is converted into the control signal. With this configuration, the control program signal and the audio signal are transmitted through the same line.

Embodiment 5

Figure 23:
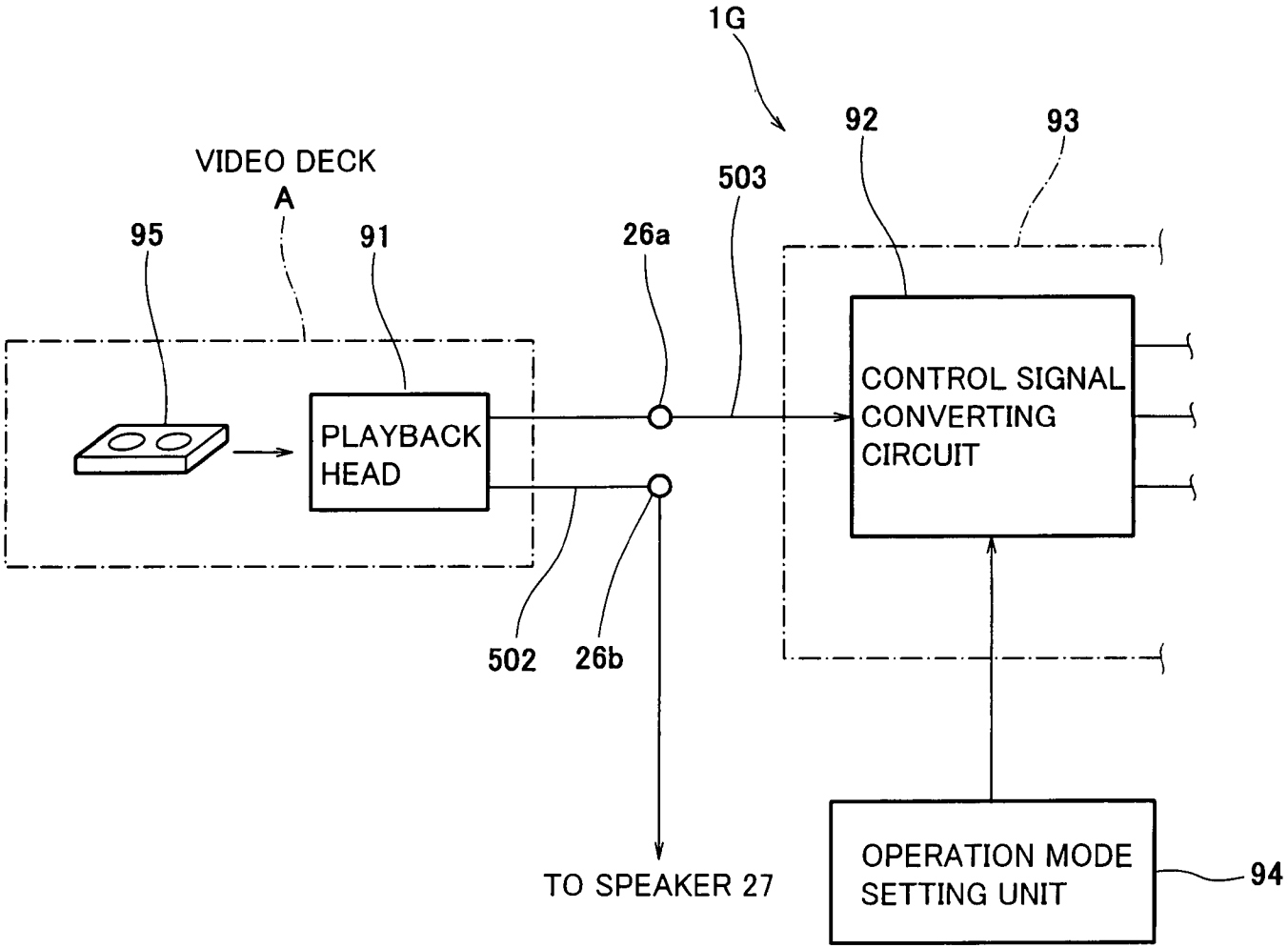
FIG. 23 is a block diagram showing a configuration of a control system of a massaging apparatus according to a fifth embodiment of the present invention.
Figure 24:
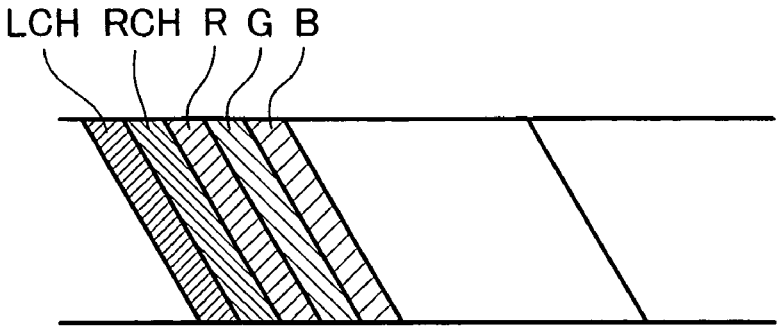
FIG. 24 is a view showing tracks of a videotape in FIG. 23 and signals stored therein, wherein FIG. 24(*a*) is a schematic view showing the videotape, and FIG. 24(*b*) is a table.

FIG. 23 is a block diagram showing a configuration of a control system of a massaging apparatus according to a fifth embodiment of the present invention. FIG. 24 is a view showing a relationship between tracks of a video tape in FIG. 23 and signals stored in the tracks, wherein FIG. 24(*a*) is a schematic view of the video tape and FIG. 24(*b*) is a table. In FIG. 23, the same reference numerals as those in FIG. 19 denote the same or corresponding parts.

As shown in FIG. 23, in this embodiment, the video deck is used as the external sound source A. An audio signal 502 output from a playback head 91 of the video deck A is input to the speaker 27 through an input terminal 26*b* of a massaging apparatus 1*g* and a control program signal 503 output from the playback head 91 is directly input to a control signal converting circuit 92 included in a control device 93 through an input terminal 26*a* of the massaging apparatus 1*g*. An operation mode setting unit 94 is connected to the control signal converting circuit 92. In the other respects, the configuration of the massaging apparatus G is similar to that of the massaging apparatus in FIG. 7.

Referring to FIGS. 23 and 24, in this embodiment, a specific video tape 95 is used. In the video tape 95, audio tracks for storing the stereo audio signal of the L channel and the R channel and video tracks for storing the video signal of three primary colors, R, G, and B, are set. In this embodiment, in the tracks of R, G, and B for video, the control program signals of the kneading operation, the tapping operation, and the vibration operation are stored. The control program signals are analog signals created as associated with the audio signal in the same manner as in FIG. 21. The control signal converting circuits 92 generates the control signals so that amplitudes of the input control program signals are associated with motor voltages and outputs the signals to the drive circuits, as in the control signal converting circuit 84 in FIG. 19. The following operation is similar to that of the fourth embodiment.

In the massaging apparatus 1*g*, with a desired video tape 95 loaded onto the video deck A, playback starts. The audio signal stored in the audio tracks of the video tape 95 are input to the speaker 27 through the playback head 91, and from the speaker 27, music of the converted audio signal is delivered. Meanwhile, the control program signals stored in the video tracks of the video tape 95 are input to the control signal converting circuit 92 through the playback head 91. The control signal converting circuits 92 generates the control signals so that amplitudes of the input control program signals are associated with motor voltages and outputs the control signals to the drive circuits. Thereby, the massaging operations according to the control programs created according to the music delivered from the speaker 27 are performed on the user.

In accordance with this embodiment, using a player of the storage medium that contains a composite audio signal in analog form as a sound source, the user feels massaged according to the music.

In the alternative example, the video tape 95 may be provided with tracks exclusively for the control programs, the playback head 91 may be configured to read data from the tracks, and a television receiver capable of outputting an image and voice of the video may be installed instead of the speaker 27. With this configuration, the user can feel massaged according to a video image as well as to the music.

Instead of the speaker as a sound output device in the above embodiments, other devices capable of converting an audio signal into audio may be used, including an earphone, a headphone, and the like.

Instead of the motor as a drive source in the above embodiment, other drive sources such as an actuator may be used.

Instead of the time division multiplexing in the above embodiment, other multiplexing methods, such as frequency division, may be used.

Instead of the CD and the video tape as the data storage medium in the above embodiment, other data storage media may be used, including a magnetic tape, a flexible disc, a hard disc, an MD, etc.

Instead of the D.C. motor as a drive motor in the above embodiment, an A.C. motor may be used. In addition, the number of motors for massaging operations is not limited to three, but two or fewer, or four or more motors may be used according to the kind of the massage.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

A massaging apparatus of the present invention is useful as a massaging apparatus of a chair type, a bed type, or the like.

The invention claimed is:

1. A massaging apparatus comprising:

a first massaging mechanism that gives a mechanical impulse to a body of a user to be massaged, including a kneading motor and a tapping motor;

a second massaging mechanism that gives vibration to the user body including a vibration motor; and a control device for controlling operations of the motors, wherein the first massaging mechanism has a massaging element connected to the kneading and tapping motors via a mechanism, the massaging element including a pair of arms and kneading heads attached on tip ends of the arms;

the first massaging mechanism is configured to cause the massaging element to perform a kneading operation by moving the pair of arms close to and away from each other or a tapping operation to reciprocate the massaging element with respect to the user, the kneading operation and the tapping operation performed by the massaging element are operated by the control device at a frequency lower than a frequency of a vibration operation of the second massaging mechanism; and the control device includes a waveform converter having a smoothing circuit and is configured to cause the waveform converter to convert an audio signal input from a sound source into a control signal for controlling the operations of the motors and control the operations of the motors using the control signal output from the waveform converter.

2. The massaging apparatus according to claim 1, the control device includes a specific frequency band signal selecting unit having a filter that selects and passes a frequency band of the audio signal.

3. The massaging apparatus according to claim 2, wherein the specific frequency band signal selecting unit includes at least one of a low pass filter, a high pass filter, and a band pass filter.

4. The massaging apparatus according to claim 2, further comprising:

an operation mode setting unit that changes and sets the operation mode of the massaging mechanisms by switching of the control signal to the motors, the operation mode setting unit being configured to switch the control signal by changing and setting the waveform converter and/or by selecting and setting a filter.

5. The massaging apparatus according to claim 4, further comprising:

an operation mode storage unit for storing plural kinds of operation modes, wherein the operation mode setting unit is configured to select the operation mode from the operation modes stored in the operation mode storage unit and switch the control signal according to the selected operation mode.

6. The massaging apparatus according to claim 4, wherein the operation mode setting unit has an operation portion with which an operator enters the operation mode.

7. The massaging apparatus according to claim 1, further comprising:

an operation mode setting unit that changes and sets the operation mode of the massaging mechanism by switching of the control signal to the motors, the operation mode setting unit being configured to switch the control signal by changing and setting the waveform converter.

8. The massaging apparatus according to claim 7, further comprising:

an operation mode storage unit for storing plural kinds of operation modes, wherein the operation mode setting unit is configured to select the operation mode from the operation modes stored in the operation mode storage unit and switch the control signal according to the selected operation mode.

9. The massaging apparatus according to claim 7, wherein the operation mode setting unit has an operation portion with which an operator enters the operation mode.

10. The massaging apparatus according to claim 1, wherein the vibration motor of the second massaging mechanism has an eccentric weight added to an output shaft thereof.

11. The massaging apparatus according to claim 1, further comprising an input terminal for receiving the audio signal from the sound source through an electric cable.

12. The massaging apparatus according to claim 1, further comprising a gain adjusting circuit for increasing or decreasing an amplitude of the control signal.

13. A massaging apparatus comprising:

a first massaging mechanism that gives a mechanical impulse to a body of a user to be massaged, including a kneading motor and a tapping motor;

a second massaging mechanism that gives vibration to the user body including a vibration motor; and a control device for controlling operations of the motors, wherein the first massaging mechanism has a massaging element connected to the kneading and tapping motors via a mechanism, the massaging element including a pair of arms and kneading heads attached on tip ends of the arms;

the first massaging mechanism is configured to cause the massaging element to perform a kneading operation by moving the pair of arms close to and away from each other or a tapping operation to reciprocate the massaging element with respect to the user, the kneading operation and the tapping operation performed by the massaging element are operated by the control device at a frequency lower than a frequency of a vibration operation of the second massaging mechanism; and the control device includes a waveform converter having an integrating circuit and is configured to cause the waveform converter to convert an audio signal input from a sound source into a control signal for controlling the operations of the motors and control the operations of the motors using the control signal output from the waveform converter.

14. The massaging apparatus according to claim 13, wherein the control device includes a specific frequency band signal selecting unit having a filter that selects and passes a frequency band of the audio signal.

15. The massaging apparatus according to claim 14, wherein the specific frequency band signal selecting unit includes at least one of a low pass filter, a high pass filter, and a band pass filter.

16. The massaging apparatus according to claim 14, further comprising:

an operation mode selling unit that changes and sets the operation mode of the massaging mechanisms by switching of the control signal to the motors, the operation mode setting unit being configured to switch the control signal by changing and setting the waveform converter and/or by selecting and setting a filter.

17. The massaging apparatus according to claim 16, further comprising:

an operation mode storage unit for storing plural kinds of operation modes, wherein the operation mode setting unit is configured to select the operation mode from the operation modes stored in the operation mode storage unit and switch the control signal according to the selected operation mode.

18. The massaging apparatus according to claim 16, wherein the operation mode setting unit has an operation portion with which an operator enters the operation mode.

19. The massaging apparatus according to claim 13, further comprising:

an operation mode setting unit that changes and sets the operation mode of the massaging mechanisms by switching of the control signal to the motors, the operation mode setting unit being configured to switch the control signal by changing and setting the waveform converter.

20. The massaging apparatus according to claim 19, further comprising:

an operation mode storage unit for storing plural kinds of operation modes, wherein the operation mode setting unit is configured to select the operation mode from the operation modes stored in the operation mode storage unit and switch the control signal according to the selected operation mode.

21. The massaging apparatus according to claim 19, wherein the operation mode setting unit has an operation portion with which an operator enters the operation mode.

22. The massaging apparatus according to claim 13, wherein the vibration motor of the second massaging mechanism has an eccentric weight added to an output shaft thereof.

23. The massaging apparatus according to claim 13, further comprising an input terminal for receiving the audio signal from the sound source through an electric cable.

24. The massaging apparatus according to claim 13, further comprising a gain adjusting circuit for increasing or decreasing an amplitude of the control signal.

25. A massaging apparatus comprising:

a first massaging mechanism that gives a mechanical impulse to a body of a user to be massaged, including a kneading motor and a tapping motor;

a second massaging mechanism that gives vibration to the user body including a vibration motor; and a control device for controlling operations of the motors, wherein the first massaging mechanism has a massaging element connected to the kneading and tapping motors via a mechanism, the massaging element including a pair of arms and kneading heads attached on tip ends of the arms;

the first massaging mechanism is configured to cause the massaging element to perform a kneading operation by moving the pair of arms close to and away from each other or a tapping operation to reciprocate the massaging element with respect to the user, the kneading operation and the tapping operation performed by the massaging element are operated by the control device at a frequency lower than a frequency of a vibration operation of the second massaging mechanism; and the control device includes a waveform converter having a waveform converting circuit that converts a waveform of an audio signal input from a sound source and a bias circuit that adds a signal to a signal output from the waveform converter for causing the massaging element to continue the kneading operation or the tapping operation during a time period in which there is no audio signal from the sound source, the operation of the motors being configured to be controlled by a control signal output from the bias circuit.

26. The massaging apparatus according to claim 25, wherein the control device includes a specific frequency band signal selecting unit having a filter that selects and passes a frequency band of the audio signal.

27. The massaging apparatus according to claim 26, wherein the specific frequency band signal selecting unit includes at least one of a low pass filter, a high pass filter, and a band pass filter.

28. The massaging apparatus according to claim 26, further comprising:

an operation mode setting unit that changes and sets the operation mode of the massaging mechanisms by switching of the control signal to the motors, the operation mode setting unit being configured to switch the control signal by changing and setting the waveform converter and/or by selecting and setting a filter.

29. The massaging apparatus according to claim 28, further comprising:

an operation mode storage unit for storing plural kinds of operation modes, wherein the operation mode setting unit is configured to select the operation mode from the operation modes stored in the operation mode storage unit and switch the control signal according to the selected operation mode.

30. The massaging apparatus according to claim 28, wherein the operation mode setting unit has an operation portion with which an operator enters the operation mode.

31. The massaging apparatus according to claim 25, further comprising a gain adjusting circuit for increasing or decreasing an amplitude of the control signal.

32. The massaging apparatus according to claim 25, further comprising:

an operation mode setting unit that changes and sets the operation mode of the massaging mechanisms by switching of the control signal to the motors, the operation mode setting unit being configured to switch the control signal by changing and setting the waveform converter.

33. The massaging apparatus according to claim 32, further comprising:

an operation mode storage unit for storing plural kinds of operation modes, wherein the operation mode setting unit is configured to select the operation mode from the operation modes stored in the operation mode storage unit and switch the control signal according to the selected operation mode.

34. The massaging apparatus according to claim 32, wherein the operation mode setting unit has an operation portion with which an operator enters the operation mode.

35. The massaging apparatus according to claim 25, wherein the vibration motor of the second massaging mechanism has an eccentric weight added to an output shaft thereof.

36. The massaging apparatus according to claim 25, further comprising an input terminal for receiving the audio signal from the sound source through an electric cable.

37. A massaging apparatus comprising:

a first massaging mechanism that gives a mechanical impulse to a body of a user to be massaged, including a kneading motor and a tapping motor;

a second massaging mechanism that gives vibration to the user body including a vibration motor; and a control device for controlling operations of the motors, wherein the first massaging mechanism has a massaging element connected to the kneading and tapping motors via a mechanism, the massaging element including a pair of arms and kneading heads attached on tip ends of the arms;

the first massaging mechanism is configured to cause the massaging element to perform a kneading operation by moving the pair of arms close to and away from each other or a tapping operation to reciprocate the massaging element with respect to the user, the kneading operation and the tapping operation performed by the massaging element are operated by the control device at a frequency lower than a frequency of a vibration operation of the second massaging mechanism; and the control device is configured to demodulate a MIDI signal input from a sound source into a control signal such that channels of the MIDI signal for independently controlling respective of plural electronic instruments respectively corresponding to the kneading operation, the tapping operation, and other massage operations of the massaging mechanisms and to control the operations of the motors using the converted control signal.

38. The massaging apparatus according to claim 37, wherein the MIDI signal is composed of a plurality of music signals representing parts of a music piece, and the control device is configured to convert at least one of the plurality of music signals into the control signal.

39. A massaging apparatus comprising:

a first massaging mechanism that gives a mechanical impulse to a body of a user to be massaged, including a kneading motor and a tapping motor;

a second massaging mechanism that gives vibration to the user body including a vibration motor; and a control device for controlling operations of the motors, wherein the first massaging mechanism has a massaging element connected to the kneading and tapping motors via a mechanism, the massaging element including a pair of arms and kneading heads attached on tip ends of the arms;

the first massaging mechanism is configured to cause the massaging element to perform a kneading operation by moving the pair of arms close to and away from each other or a tapping operation to reciprocate the massaging element with respect to the user, the kneading operation and the tapping operation performed by the massaging element are operated by the control device at a frequency lower than a frequency of a vibration operation of the second massaging mechanism; and the control device being configured to convert a control program signal included in a composite audio signal which is input from a sound source and is composed of an audio signal and the control program signal, the control program signal being created to cause the massaging mechanisms to operate according to the audio signal, and to control the operations of the motors using the converted control signal, wherein the composite audio signal is configured such that the control program signal is advanced by predetermined time with respect to the audio signal output to a signal path reaching a sound output device from which audio is listened to by the user, thereby correcting response delay of the operations of the massaging mechanisms based on the control program signal to adapt the operations of the massaging mechanisms to tempo of music based on the audio signal.

* * * * *